US009315024B2

(12) United States Patent
Miyamoto et al.

(10) Patent No.: US 9,315,024 B2
(45) **Date of Patent: *Apr. 19, 2016**

(54) DROPLET DISCHARGING METHOD AND DROPLET DISCHARGING APPARATUS

(71) Applicant: SEIKO EPSON CORPORATION, Tokyo (JP)

(72) Inventors: Toru Miyamoto, Shiojiri (JP); Tomohiro Yuda, Minowa-machi (JP); Bunji Ishimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/461,040

(22) Filed: Aug. 15, 2014

(65) Prior Publication Data

US 2015/0054869 A1 Feb. 26, 2015

(30) Foreign Application Priority Data

Aug. 26, 2013 (JP) ..... 2013-174218

(51) Int. Cl.

| | |
|---|---|
| ***B41J 29/38*** | (2006.01) |
| ***B41J 2/135*** | (2006.01) |
| ***B41J 2/15*** | (2006.01) |
| ***B41J 2/21*** | (2006.01) |
| ***B41J 2/51*** | (2006.01) |
| ***B41J 19/14*** | (2006.01) |

(52) U.S. Cl.

CPC *B41J 2/15* (2013.01); *B41J 2/2132* (2013.01); *B41J 2/51* (2013.01); *B41J 19/142* (2013.01)

(58) Field of Classification Search

CPC ..... B41J 2/2132; B41J 2/2146; B41J 2/155; B41J 19/142; B41J 2/15; B41J 2/51

USPC ..... 347/9, 20, 40, 44

See application file for complete search history.

(56) References Cited

U.S. PATENT DOCUMENTS

| | | | | |
|---|---|---|---|---|
| 5,946,011 | A | 8/1999 | Kanaya | |
| 6,439,677 | B1 | 8/2002 | Kanaya et al. | |
| 8,376,488 | B2 | 2/2013 | Shimizu | |
| 2009/0073202 | A1 | 3/2009 | Kanda et al. | |
| 2011/0138608 | A1 * | 6/2011 | Tanase | B41J 2/01 29/592.1 |
| 2012/0223987 | A1 | 9/2012 | Arakane | |
| 2015/0054871 | A1 * | 2/2015 | Miyamoto et al. | 347/9 |

FOREIGN PATENT DOCUMENTS

| | | |
|---|---|---|
| JP | 06-047925 | 2/1994 |
| JP | 10-323978 | 12/1998 |

* cited by examiner

*Primary Examiner* — Jannelle M Lebron

(74) *Attorney, Agent, or Firm* — Workman Nydegger

(57) ABSTRACT

A droplet discharging method includes: forming a plurality of dots on a first region of a medium, on a second region which is positioned in a −Y direction from the first region, and on a third region which is positioned in the −Y direction from the second region. The dots are formed on the first region by using a first head and a second head to cause a second head use ratio to be constant, the dots are formed on the second region by using the first head and the second head so as to cause the second head use ratio to be increased from a value less than a first set value to a value greater than a second set value greater than the first set value in the −Y direction, and the dots are formed on the third region by using the second head.

13 Claims, 13 Drawing Sheets

DROPLET DISCHARGING METHOD AND DROPLET DISCHARGING APPARATUS

BACKGROUND

1. Technical Field

The present invention relates to a droplet discharging method and a droplet discharging apparatus.

2. Related Art

As an example of a droplet discharging apparatus, an ink jet printer which records (prints) an image by discharging ink droplets on various recording media such as a sheet or film is known. The ink jet printer alternately repeats, for example, a dot forming operation of, while moving (scanning) a head provided with a plurality of nozzles in a main scanning direction, discharging ink from each of the nozzles onto a recording medium and a transporting operation of moving (transporting) the recording medium in a sub-scanning direction perpendicular to the main scanning direction to form dots (dot rows) which are lined up in the main scanning direction to be lined up in the sub-scanning direction, thereby forming an image on the recording medium.

In this type of ink jet printer, as a method for further increasing a recording speed, a method of increasing the number of nozzles has been employed. Specifically, this is a method of increasing the number of dots which are discharged and formed in a single scanning process by increasing the number of nozzles per head or lining up a plurality of heads to increase a recording speed. As a high-speed recording method, for example, there is a method (band recording method) of forming an image by completing image formation of a width (band) corresponding to the length of a row constituted by a plurality of nozzles lined up in a sub-scanning direction through a single scanning process, transporting a recording medium in the sub-scanning direction by the width, forming bands to be lined up in the sub-scanning direction so as to allow the end portion of the formed band to abut the end portion of the band formed by the subsequent scanning process, and repeating the above operations. In the case of the band recording method, there may be a case where striped patterns (banding) are formed along the boundary between the bands. This is caused by variations in accuracy of transport in the sub-scanning direction, an effect of the difference between the characteristics of switching parts of nozzle rows, and the like.

In JP-A-6-47925, as a method of suppressing the degradation in image quality due to the banding, a method of performing partial overlap (POL control) is suggested. POL control is a method of dispersing variations in characteristics or accuracy, and specifically, as the simplest example, is a method of causing the lower end region of a band formed by a scanning process of a head and the upper end region of a band formed by the subsequent scanning process of the head to overlap each other and forming dots of a part of the lower end region of the initially formed band and dots of a part of the upper end region of the subsequently formed band to overlap each other in the same region. In JP-A-10-323978, a method of forming a high-quality image by using a plurality of nozzle rows is suggested.

However, in a case where a larger number of nozzles are provided in the head and a plurality of the heads are configured to be lined up in the sub-scanning direction to achieve higher speed, there is a problem in that there is a difference (for example, difference in concentration or the like) between an image formed on the regions of the upper and lower end portions of the recording medium in the sub-scanning direction (recording start portion and end portion) and an image formed on the center region, and the difference is visually recognized in a transition region thereof (a transition region which connects the regions of the upper and lower end portions to the region of the center portion).

Specifically, since the heads are configured to be lined up in the long region in the sub-scanning direction, there may be a case where partial overlap between the plurality of heads cannot be performed on the upper and lower end portions of the recording medium although partial overlap between scanning processes is possible. As a result, for example, in a case where there is a slight difference in characteristics between the heads (for example, the difference in the amount of ink droplets discharged from the nozzles), there may be a difference in image between the image region formed only by a single head corresponding to each of the upper and lower end portions and the image region subjected to POL control between the plurality of heads. In this case, there is a problem in that the difference between the images is visually recognized in the transition region.

SUMMARY

The invention can be realized in the following forms or application examples.

Application Example 1

According to this application example, there is provided a droplet discharging method including: alternately repeating a droplet discharging operation of discharging droplets onto a medium by using a first head and a second head that move in an X direction or in a −X direction and a medium moving operation of moving the medium in a Y direction intersecting the X direction to form a plurality of dots on a first region of the medium, a second region which is positioned in a −Y direction from the first region to be connected to the first region, and a third region which is positioned in the −Y direction from the second region to be connected to the second region, in which the dots are formed on the first region by using the first head and the second head so that, when a ratio of the number of dots formed by using the second head to the sum of the number of dots formed by using the first head and the number of dots formed by using the second head is referred to as a second head use ratio in rows of the dots which are lined up in the X direction, the second head use ratio is constant, the dots are formed on the second region by using the first head and the second head to cause the second head use ratio to be increased from a value less than a first set value to a value greater than a second set value greater than the first set value in the −Y direction in a plurality of rows of the dots lined up in the X direction, and the dots are formed on the third region by using the second head.

According to the application example, the first region is formed of the dots by using the first head and the second head to cause the second head use ratio to be constant. In addition, the second region which is positioned in the −Y direction from the first region to be connected to the first region is formed of the dots by using the first head and the second head so that the second head use ratio increases from the value less than the first set value to the value greater than the second set value greater than the first set value in the −Y direction in the plurality of rows of dots lined up in the X direction. The third region which is positioned in the −Y direction from the second region to be connected to the second region is formed of the dots by using the second head.

That is, the second region is positioned between the first region which is formed of the dots by using the first head and the second head to cause the second head use ratio to be constant and the third region which is formed of the dots by using the second head. The second region is configured as a region in which the second head use ratio increases from the value less than the first set value to the value greater than the second set value greater than the first set value in the −Y direction (that is, in a direction from the first region to the third region). As a result, for example, even in a case where there is a difference between the characteristics (a characteristic of discharging droplets) of the first head and the characteristics of the second head, since the second region is configured so that the influence of the second head having different characteristics gradually increases in the direction from the first region to the third region, the change therein becomes smooth. Specifically, for example, even in a case where the opening diameter of the nozzle provided in the second head is larger than that of the first head due to manufacturing variations, that is, as a result, even in a case where the discharged droplet increases in size and the individual dot diameter formed by the second head increases, the influence thereof is not suddenly significantly exhibited due to the use of the second head but a gradual increase is exhibited.

Accordingly, for example, even in a case where the partial overlap by the two heads including the first head and the second head cannot be performed, that is, even in a case where POL control between the heads having different characteristics cannot be performed on the lower end portion of the medium or the like, the difference between the image region (the first region) subjected to the POL control between the first head and the second head and the image region (the third region) formed only by the second head can be smoothly transitioned. As a result, the difference in the image by the heads having different characteristics is less likely to be visually recognized, and thus higher image quality can be achieved.

Application Example 2

In the droplet discharging method according to the application example, it is preferable that the first head and the second head be provided with a plurality of nozzles which discharge the droplets and are lined up in the Y direction, and when the droplet discharging operation which is performed by moving the first head and the second head once in the X direction or in the −X direction is referred to as one pass and a ratio of the number of dots formed in one pass by using the second head to the sum of the number of dots formed by using the first head and the number of dots formed by using the second head is referred to as a second head one pass use ratio in the rows of the dots which are lined up in the X direction, the second head one pass use ratio in the second region be increased from a value less than a third set value to a value greater than a fourth set value greater than the third set value and be decreased from the value greater than the fourth set value to a value less than the third set value in the −Y direction in the plurality of rows of the dots which are formed in one pass by the plurality of nozzles provided in the second head and are lined up in the X direction.

According to this application example, in the second region, in the plurality of rows of dots lined up in the X direction, which are formed in one pass by the plurality of nozzles provided in the second head, the second head one pass use ratio is increased from a value less than the third set value to a value greater than the fourth set value greater than the third set value in the −Y direction, and is decreased from the value greater than the fourth set value to a value less than the third set value.

That is, the second head one pass use ratio is increased from the value less than the third set value to the value greater than the fourth set value greater than the third set value and is decreased from the value greater than the fourth set value to the value less than the third set value in the −Y direction in each of the passes, and the second region is formed by overlapping passes. By appropriately setting the third set value and the fourth set value to be balanced with the first set value and the second set value, the second region formed by overlapping the passes is reliably configured as a region in which the second head use ratio increases from the value less than the first set value to the value greater than the second set value greater than the first set value in the −Y direction (that is, in the direction from the first region to the third region).

Application Example 3

In the droplet discharging method according to the application example, it is preferable that the first set value be 70%, and the second set value be 80%.

According to this application example, the second region is configured as a region in which the second head use ratio increases from the value less than 70% to the value greater than 80% in the −Y direction (that is, in the direction from the first region to the third region). For example, even in a case where there is a difference between the characteristics of the first head and the characteristics of the second head, since the second region is configured so that the influence of the second head having different characteristics increases from a value less than 70% to a value greater than 80% in the direction from the first region to the third region, that is, for example, the second head use ratio does not suddenly become 100%, the change therein becomes smooth.

Application Example 4

In the droplet discharging method according to the application example, the first head may be positioned in the Y direction with respect to the second head.

According to this application example, since the medium moving operation is performed in the Y direction, the −Y direction is the lower end portion direction of the medium. In a case where it is difficult to apply POL control by the plurality of heads to a lower end portion, the second head which is positioned in the −Y direction from the first head is used to form dots on the lower end portion. According to this application, for example, even in the case where there is a difference between the characteristics of the first head and the characteristics of the second head, the difference between the center portion region (the first region) subjected to the POL control between the first head and the second head and the lower end portion region (the third region) formed only by the second head can be smoothly transitioned.

Application Example 5

In the droplet discharging method according to the application example, the first head and the second head which discharge the droplets having the same composition may be mounted in a carriage as a head set, and the droplet discharging operation may cause the carriage to move in the X direction or the −X direction.

According to this application example, the first head and the second head are mounted in the carriage as the head set and discharge droplets having the same composition while moving in the X direction or in the −X direction along with the carriage. That is, the head set is used as a single head provided with a larger number of nozzles. According to this application example, even in the case where there is a difference in characteristics between the first head and the second head which constitute the head set, higher image quality in which deterioration of the image caused by the difference is less likely to be visually recognized can be achieved.

Application Example 6

In the droplet discharging method according to the application example, a plurality of the head sets may be mounted in the carriage, and the droplets from the respective head sets may have different compositions.

According to this application example, even in a case where there is a difference in characteristics between the first head and the second head which constitute each of the plurality of head sets, deterioration of an image caused by the difference is less likely to be visually recognized. As a result, for example, higher quality full-color image can be achieved.

Application Example 7

According to this application example, there is provided a droplet discharging method including: alternately repeating a droplet discharging operation of discharging droplets onto a medium by using a first head and a second head that move in an X direction or in a −X direction and a medium moving operation of moving the medium in a Y direction intersecting the X direction to form a plurality of dots on the medium, in which, in a case where all the dots are formed at all the positions on the medium, where the dots can be formed, by using the first head and the second head, a first region which is formed of a plurality of the dots formed by using the first head and the second head so that, when a ratio of the number of dots formed by using the second head to the sum of the number of dots formed by using the first head and the number of dots formed by using the second head is referred to as a second head use ratio in rows of the dots which are lined up in the X direction, the second head use ratio is constant, a second region which is positioned in a −Y direction from the first region to be connected to the first region and is formed of a plurality of the dots formed by using the first head and the second head to cause the second head use ratio to be increased from a value less than 70% to a value greater than 80% in the −Y direction, and a third region which is formed of a plurality of the dots formed by using the second head are formed.

According to this application example, in the case where all the dots are formed at all the positions on the medium, where the dots can be formed, by using the first head and the second head, the first region formed of the dots by using the first head and the second head to cause the second head use ratio to be constant, the second region which is positioned in the −Y direction from the first region to be connected to the first region and is formed of the dots by using the first head and the second head so that, when the ratio of the number of dots formed by using the second head to the sum of the number of dots formed by using the first head and the number of dots formed by using the second head is referred to as the second head use ratio in rows of the dots which are lined up in the X direction, the second head use ratio is increased from the value less than 70% to the value greater than 80% in the −Y direction, and the third region which is positioned in the −Y direction from the second region to be connected to the second region and is formed of the plurality of dots formed by using the second head are formed.

That is, dots are formed on the medium over the first region to the third region in a solid pattern. In addition, the second region which connects the first region to the third region is configured as the region in which the second head use ratio increases from the value less than 70% to the value greater than 80% in the −Y direction (that is, in the direction from the first region to the third region). Accordingly, for example, in a case where the first head and the second head discharge ink droplets having the same composition, even when there is a difference in characteristics between the first head and the second head, a solid pattern with higher quality in which deterioration (irregularity or the like) of the image caused by the difference is less likely to be visually recognized can be achieved.

Furthermore, for example, in a case where the first head and the second head discharge ink droplets having different compositions (for example, ink droplets having different colors), the first region having a constant second head use ratio, the third region which is formed of the ink droplets discharged from the second head, and the second region which connects the first and third regions and in which the second head use ratio increases can be visually recognized by the dots having different colors. For example, this can be applied to the verification of a function and the like associated with this application example.

Application Example 8

According to this application example, there is provided a droplet discharging apparatus including: a first head and a second head which form dots by discharging droplets onto a medium; a scanning moving unit which moves the first head and the second head in ±X directions on the medium; a medium moving unit which moves the medium in a Y direction intersecting the X direction; and a control unit which performs control of driving of the scanning moving unit and the medium moving unit and control discharging of the droplets from the first head and the second head, in which the control unit alternately repeats a droplet discharging operation of discharging the droplets onto the medium by using the first head and the second head that are moved by the scanning moving unit in the X direction or in the −X direction and a medium moving operation of moving the medium by the medium moving unit in the Y direction intersecting the X direction to form the dots on a first region by using the first head and the second head so that, when a ratio of the number of dots formed by using the second head to the sum of the number of dots formed by using the first head and the number of dots formed by using the second head is referred to as a second head use ratio in rows of the dots which are lined up in the X direction, the second head use ratio is constant, to form the dots on a second region which is positioned in a −Y direction from the first region to be connected to the first region by using the first head and the second head so that the second head use ratio is increased from a value less than a first set value to a value greater than a second set value greater than the first set value in the −Y direction in a plurality of rows of the dots lined up in the X direction, and to form the dots on a third region which is positioned in the −Y direction from the second region to be connected to the second region by using the second head.

According to the application example, the first region is formed of the dots by using the first head and the second head to cause the second head use ratio to be constant. In addition, the second region which is positioned in the −Y direction from the first region to be connected to the first region is formed of the dots by using the first head and the second head so that the second head use ratio increases from the value less than the first set value to the value greater than the second set value greater than the first set value in the −Y direction in the plurality of rows of dots lined up in the X direction. The third region which is positioned in the −Y direction from the second region to be connected to the second region is formed of the dots by using the second head.

That is, the second region is positioned between the first region which is formed of the dots by using the first head and the second head to cause the second head use ratio to be constant and the third region which is formed of the dots by using the second head. The second region is configured as a region in which the second head use ratio increases from the value less than the first set value to the value greater than the second set value greater than the first set value in the −Y direction (that is, in a direction from the first region to the third region). As a result, for example, even in a case where there is a difference between the characteristics (a characteristic of discharging droplets) of the first head and the characteristics of the second head, since the second region is configured so that the influence of the second head having different characteristics gradually increases in the direction from the first region to the third region, the change therein becomes smooth. Specifically, for example, even in a case where the opening diameter of the nozzle provided in the second head is larger than that of the first head due to manufacturing variations, that is, as a result, even in a case where the discharged droplet increases in size and the individual dot diameter formed by the second head increases, the influence thereof is not suddenly significantly exhibited due to the use of the second head but a gradually increase is exhibited.

Accordingly, for example, even in a case where the partial overlap by the two heads including the first head and the second head cannot be performed, that is, even in a case where POL control between the heads having different characteristics cannot be performed on the upper end portion of the medium or the like, the difference between the image region (the first region) subjected to the POL control between the first head and the second head and the image region (the third region) formed only by the second head can be smoothly transitioned. As a result, the difference in the image by the heads having different characteristics is less likely to be visually recognized, and thus higher image quality can be achieved.

Application Example 9

In the droplet discharging apparatus according to the application example, it is preferable that the first head and the second head be provided with a plurality of nozzles which discharge the droplets and are lined up in the Y direction, and when the droplet discharging operation which is performed by moving the first head and the second head once in the X direction or in the −X direction is referred to as one pass and a ratio of the number of dots formed in one pass by using the second head to the sum of the number of dots formed by using the first head and the number of dots formed by using the second head is referred to as a second head one pass use ratio in the rows of the dots which are lined up in the X direction, the control unit cause the second head one pass use ratio in the second region to be increased from a value less than a third set value to a value greater than a fourth set value greater than the third set value and to be decreased from the value greater than the fourth set value to a value less than the third set value in the −Y direction in the plurality of rows of the dots which are formed in one pass by the plurality of nozzles provided in the second head and are lined up in the X direction.

According to this application example, in the second region, in the plurality of rows of dots lined up in the X direction, which are formed in one pass by the plurality of nozzles provided in the second head, the second head one pass use ratio is increased from a value less than the third set value to a value greater than the fourth set value greater than the third set value in the −Y direction, and is decreased from the value greater than the fourth set value to a value less than the third set value.

That is, the second head one pass use ratio is increased from the value less than the third set value to the value greater than the fourth set value greater than the third set value and is decreased from the value greater than the fourth set value to the value less than the third set value in the −Y direction in each of the passes, and the second region is formed by overlapping passes. By appropriately setting the third set value and the fourth set value to be balanced with the first set value and the second set value, the second region formed by overlapping the passes is reliably configured as a region in which the second head use ratio increases from the value less than the first set value to the value greater than the second set value greater than the first set value in the −Y direction (that is, in the direction from the first region to the third region).

Application Example 10

In the droplet discharging apparatus according to the application example, it is preferable that the first set value be 70%, and the second set value be 80%.

According to this application example, the second region is configured as a region in which the second head use ratio increases from the value less than 70% to the value greater than 80% in the −Y direction (that is, in the direction from the first region to the third region). For example, even in a case where there is a difference between the characteristics of the first head and the characteristics of the second head, since the second region is configured so that the influence of the second head having different characteristics increases from a value less than 70% to a value greater than 80% in the direction from the first region to the third region, that is, for example, the second head use ratio does not suddenly become 100%, the change therein becomes smooth.

Application Example 11

In the droplet discharging apparatus according to the application example, the first head may be positioned in the Y direction with respect to the second head.

According to this application example, since the medium moving operation is performed in the Y direction, the −Y direction is the lower end portion direction of the medium. In a case where it is difficult to apply POL control by the plurality of heads to a lower end portion, the second head which is positioned in the −Y direction from the first head is used to form dots on the lower end portion. According to this application, for example, even in the case where there is a difference between the characteristics of the first head and the characteristics of the second head, the difference between the center portion region (the first region) subjected to the POL control between the first head and the second head and the lower end portion region (the third region) formed only by the second head can be smoothly transitioned.

Application Example 12

In the droplet discharging apparatus according to the application example, the first head and the second head which discharge the droplets having the same composition may be mounted in a single carriage as a head set.

According to this application example, the first head and the second head are mounted in the carriage as the head set and discharge droplets having the same composition while moving in the X direction or in the −X direction along with the carriage. That is, the head set is used as a single head provided with a larger number of nozzles. According to this application example, even in the case where there is a difference in characteristics between the first head and the second head which constitute the head set, higher image quality in which deterioration of the image caused by the difference is less likely to be visually recognized can be achieved.

Application Example 13

In the droplet discharging apparatus according to the application example, a plurality of the head sets may be mounted in the carriage, and the droplets from the respective head sets may have different compositions.

According to this application example, even in a case where there is a difference in characteristics between the first head and the second head which constitute each of the plurality of head sets, deterioration of an image caused by the difference is less likely to be visually recognized. As a result, for example, higher quality full-color image can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described with reference to the drawings. The following is the embodiment of the invention and does not limit the invention. For ease of description, there may be a case where each of the drawings is illustrated at a scale different from the actual scale.

Embodiment 1

Figure 1A:
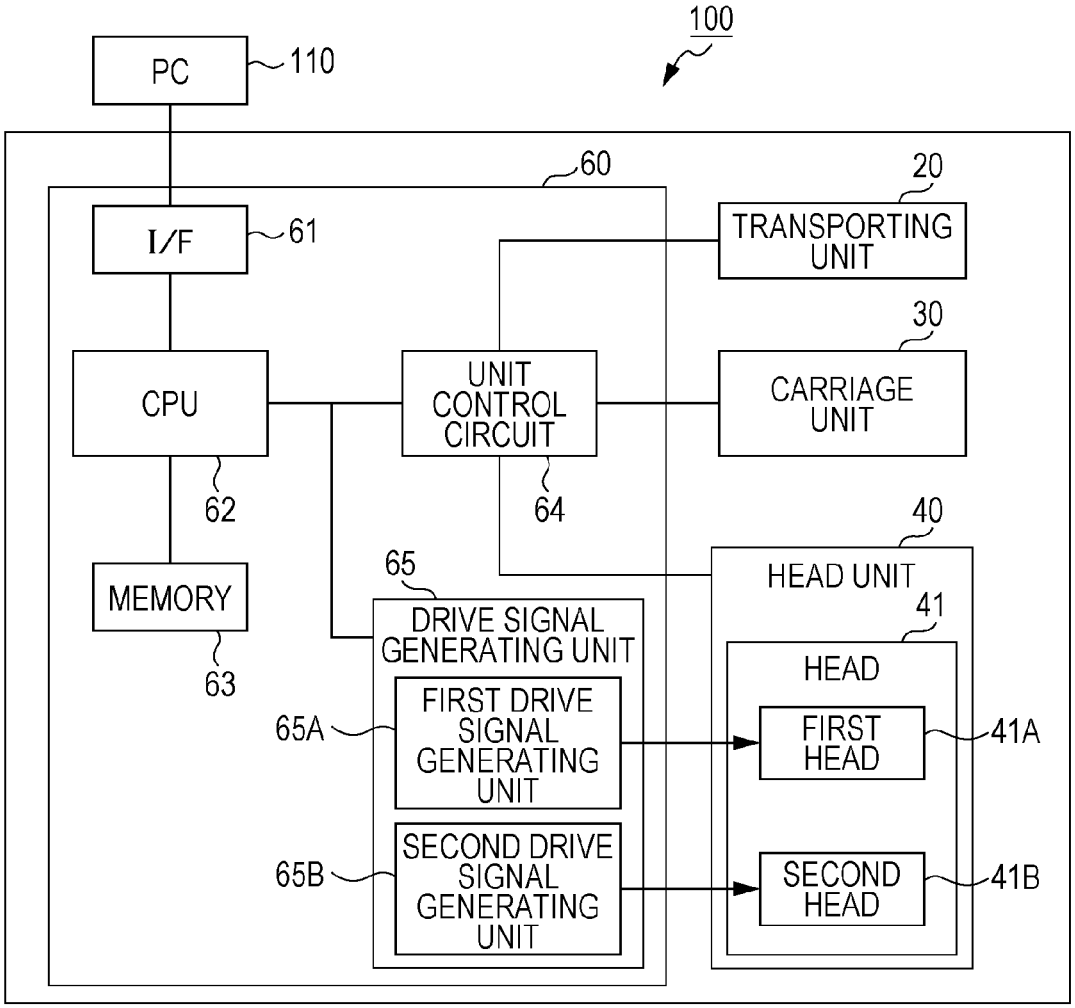
FIG. 1A is a block diagram illustrating the overall configuration of an ink jet printer as a droplet discharging apparatus according to Embodiment 1.
Figure 1B:
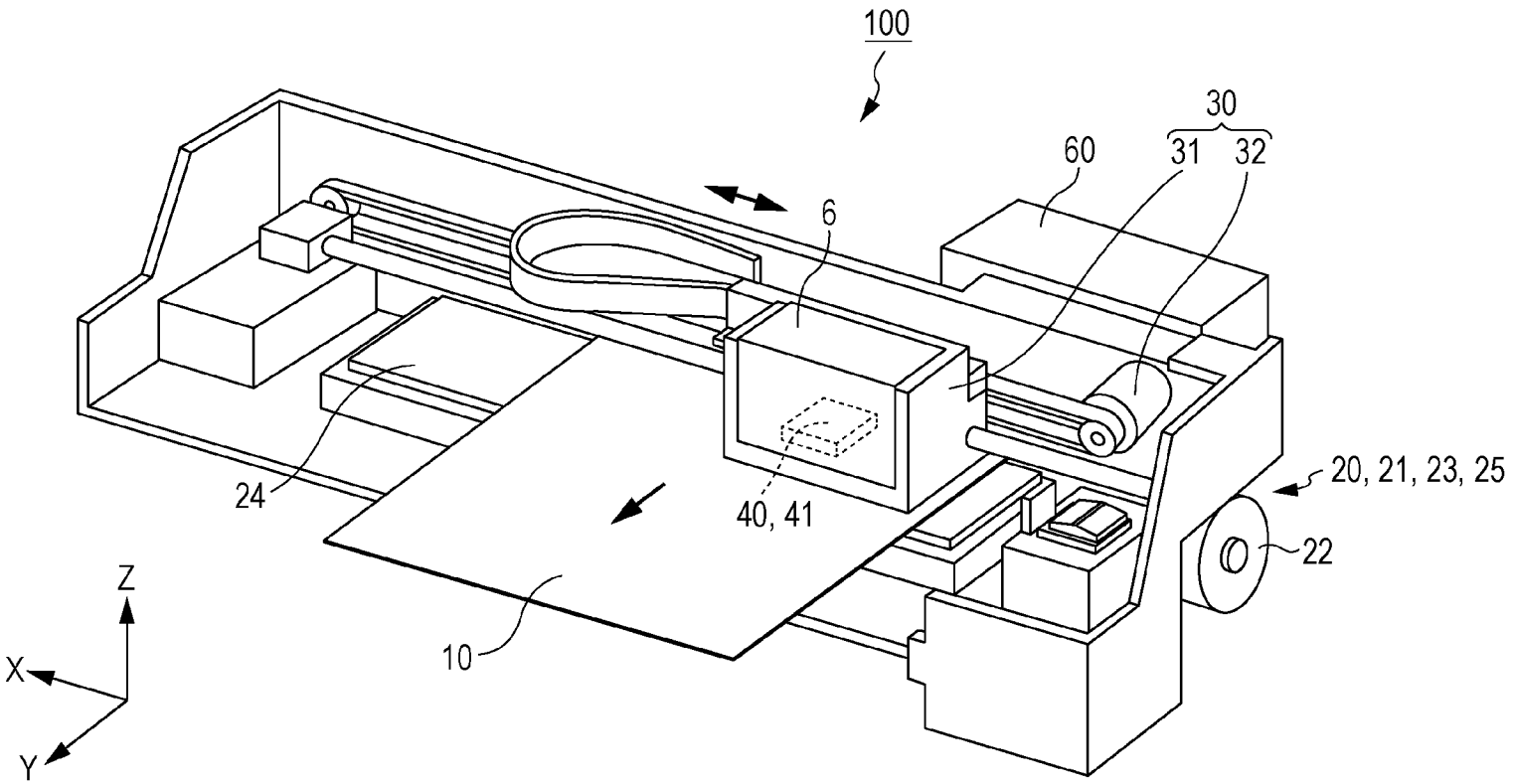
FIG. 1B is a perspective view thereof.

FIG. 1A is a block diagram of the overall configuration of an ink jet printer 100 as a droplet discharging apparatus according to Embodiment 1, and FIG. 1B is a perspective view thereof.

In the X, Y, and Z axes illustrated in the figure, the ink jet printer 100 is installed on the XY plane. The ±X direction (X-axis direction) is described as a main scanning direction which will be described later, the Y direction is described as a sub-scanning direction which will be described later, and the Z direction is described as a height direction.

First, the basic configuration of the ink jet printer 100 will be described.

Basic Configuration of Ink Jet Printer

The ink jet printer 100 includes a transporting unit 20 as a "medium moving unit", a carriage unit 30 as a "scanning moving unit", a head unit 40, and a controller 60 as a "control unit". The ink jet printer 100 which receives printing data (image forming data) from a computer 110 as an external apparatus controls each of the units (the transporting unit 20, the carriage unit 30, and the head unit 40) using the controller 60. The controller 60 controls each of the units based on the printing data received from the computer 110 to print an image (form an image) on a sheet 10 as a "medium".

The transporting unit 20 is for moving the sheet 10 in a predetermined transport direction (the Y direction illustrated in FIG. 1B, hereinafter, also referred to as the sub-scanning direction). The transporting unit 20 includes a sheet feed roller 21, a transport motor 22, a transport roller 23, a platen 24, a sheet discharge roller 25, and the like. The sheet feed roller 21 is a roller for feeding the sheet 10, which is inserted into a sheet insertion hole (not illustrated), into the ink jet printer 100. The transport roller 23 is a roller for transporting the sheet 10, which is fed by the sheet feed roller 21, to a region where printing can be performed, and is driven by the transport motor 22. The platen 24 supports the sheet 10 during printing. The sheet discharge roller 25 is a roller for discharging the sheet 10 to the outside of the printer, and is provided on the downstream side in the sub-scanning direction with respect to the region where printing can be performed.

The carriage unit 30 is for moving (scanning) a head 41, which will be described later, in a predetermined movement direction (the X-axis direction illustrated in FIG. 1B, hereinafter, also referred to as the main scanning direction). The carriage unit 30 includes a carriage 31, a carriage motor 32, and the like. The carriage 31 can reciprocate in the main scanning direction, and is driven by the carriage motor 32. The carriage 31 detachably holds an ink cartridge 6 that stores ink.

The head unit 40 is for discharging the ink as "droplets" (hereinafter, referred to as ink droplets) onto the sheet 10. The head unit 40 includes the head 41 provided with a plurality of nozzles. Since the head 41 is mounted on the carriage 31, when the carriage 31 moves in the main scanning direction, the head 41 also moves in the main scanning direction. The head 41 intermittently discharges the ink during the movement in the main scanning direction such that a row of dots (raster line) is formed on the sheet 10 along the main scanning direction.

The head 41 includes two heads (a first nozzle group 41A and a second nozzle group 41B). The configuration of the head 41 will be described later.

The controller 60 is the control unit for controlling the ink jet printer 100. The controller 60 includes an interface unit 61, a CPU 62, a memory 63, a unit control circuit 64, and the like. The interface unit 61 transceiver data between the computer 110 as the external apparatus and the ink jet printer 100. The CPU 62 is an arithmetic processing unit for controlling the entire printer. The memory 63 secures an area that stores a program of the CPU 62, a work area, and the like, and includes a storage element such as a RAM or an EEPROM.

The CPU 62 controls each of the units (the transporting unit 20, the carriage unit 30, and the head unit 40) via the unit control circuit 64 according to the program stored in the memory 63.

Furthermore, a drive signal generating unit 65 is provided in the controller 60. The drive signal generating unit 65 includes a first drive signal generating unit 65A and a second drive signal generating unit 65B. The first drive signal generating unit 65A generates a first drive signal for driving the piezoelectric elements of the first nozzle group 41A. The second drive signal generating unit 65B generates a second drive signal for driving the piezoelectric elements of the second nozzle group 41B. Each of the drive signal generating units generates a drive signal for odd-numbered dots in a case of forming dots on odd-numbered dots (described later), and generates a drive signal for even-numbered dots in a case of forming dots on even-numbered dots (described later). The drive signal generating units are separated from each other. For example, when the first drive signal generating unit 65A generates the drive signal for odd-numbered dots, the second drive signal generating unit 65B may generate the drive signal for odd-numbered dots or may generate the drive signal for even-numbered dots.

When printing is performed, the controller 60 alternately repeats a "droplet discharging operation" of discharging the ink as droplets from the head 41 during the movement in the main scanning direction and a transporting operation as a "medium moving operation" of moving the sheet 10 in the sub-scanning direction to print an image including a plurality of dots (a countless number of dots) on the sheet 10. The droplet discharging operation is called a "pass", and an n-th pass is called "pass n".

Configuration of Head

Figure 2:
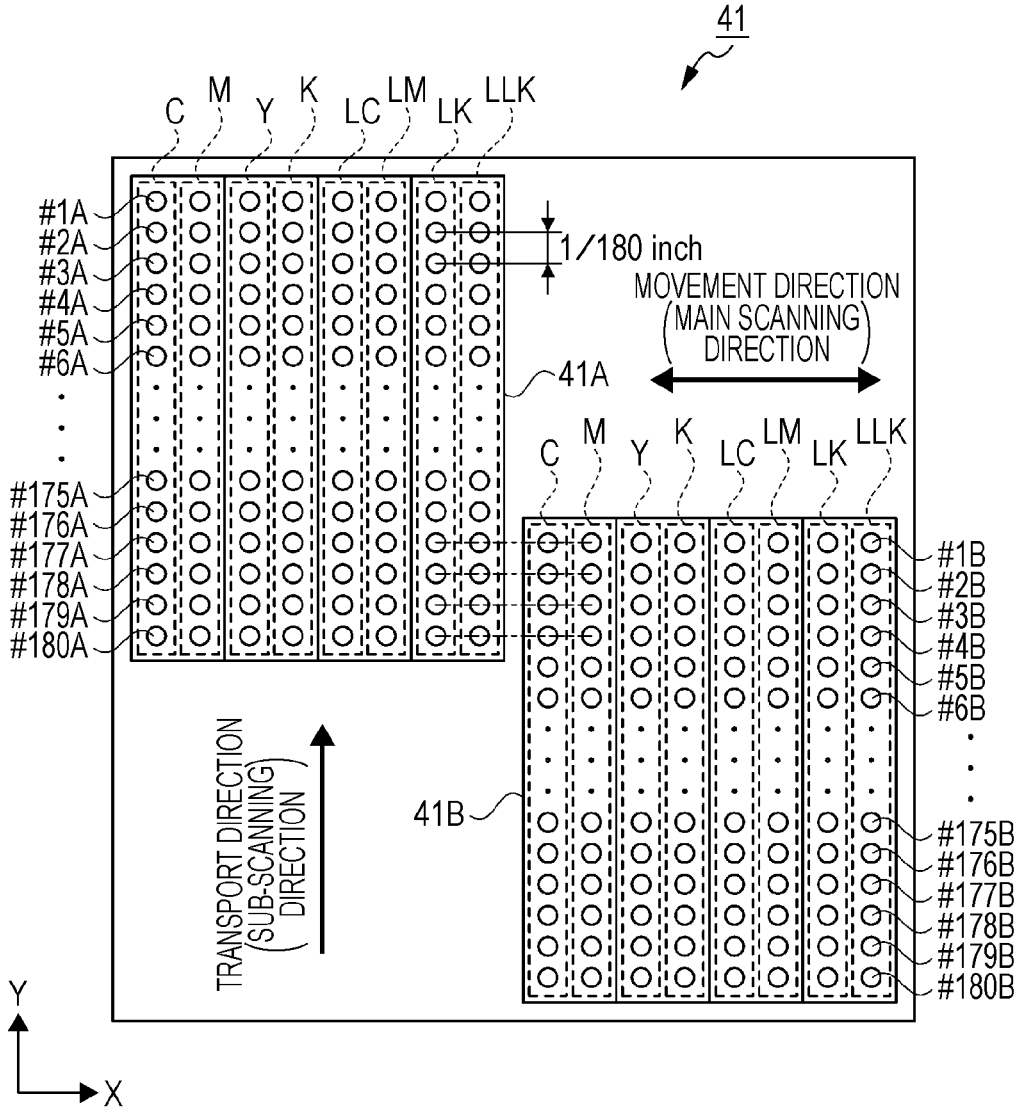
FIG. 2 is an explanatory view illustrating an example of the arrangement of nozzles.

FIG. 2 is an explanatory view illustrating the arrangement of the nozzles included in the head 41. The head 41 includes the first nozzle group 41A and the second nozzle group 41B as two heads (nozzle groups). 8 nozzle rows are provided in each of the nozzle groups, and discharge holes of the nozzles are open to the lower surface of the head 41. The 8 nozzle rows respectively discharge dark cyan (C) ink, dark magenta (M) ink, yellow (Y) ink, dark black (K) ink, light cyan (LC) ink, light magenta (LM) ink, light black (LK) ink, and light light black (LLK) ink.

180 nozzles (nozzles #1A to #180A or nozzles #1B to #180B) lined up in the sub-scanning direction are provided in each of the nozzle rows at a nozzle pitch of 180 dpi. In FIG. 2, nozzles disposed closer to the downstream side (+Y side) in the sub-scanning direction are denoted by smaller numbers. Each of the nozzles is provided with the piezoelectric element (not illustrated) as a drive element for discharging the ink droplet from the corresponding nozzle.

The first nozzle group 41A is provided closer to the downstream side in the sub-scanning direction than the second nozzle group 41B. The first nozzle group 41A and the second nozzle group 41B are provided so that the positions of 4 nozzles thereof overlap in the sub-scanning direction. For example, the position of the nozzle #177A of the first nozzle group 41A in the sub-scanning direction is the same as the position of the nozzle #1B of the second nozzle group 41B in the sub-scanning direction. Accordingly, when the nozzle #177A of the first nozzle group 41A can form a dot on a certain pixel during the droplet discharging operation, the nozzle #1B of the second nozzle group 41B can also form a dot on the pixel.

A combination of the nozzle rows of the first nozzle group 41A and the second nozzle group 41B in which the same type of ink (ink having the same composition) is discharged is referred to as a "head set".

Figure 3:
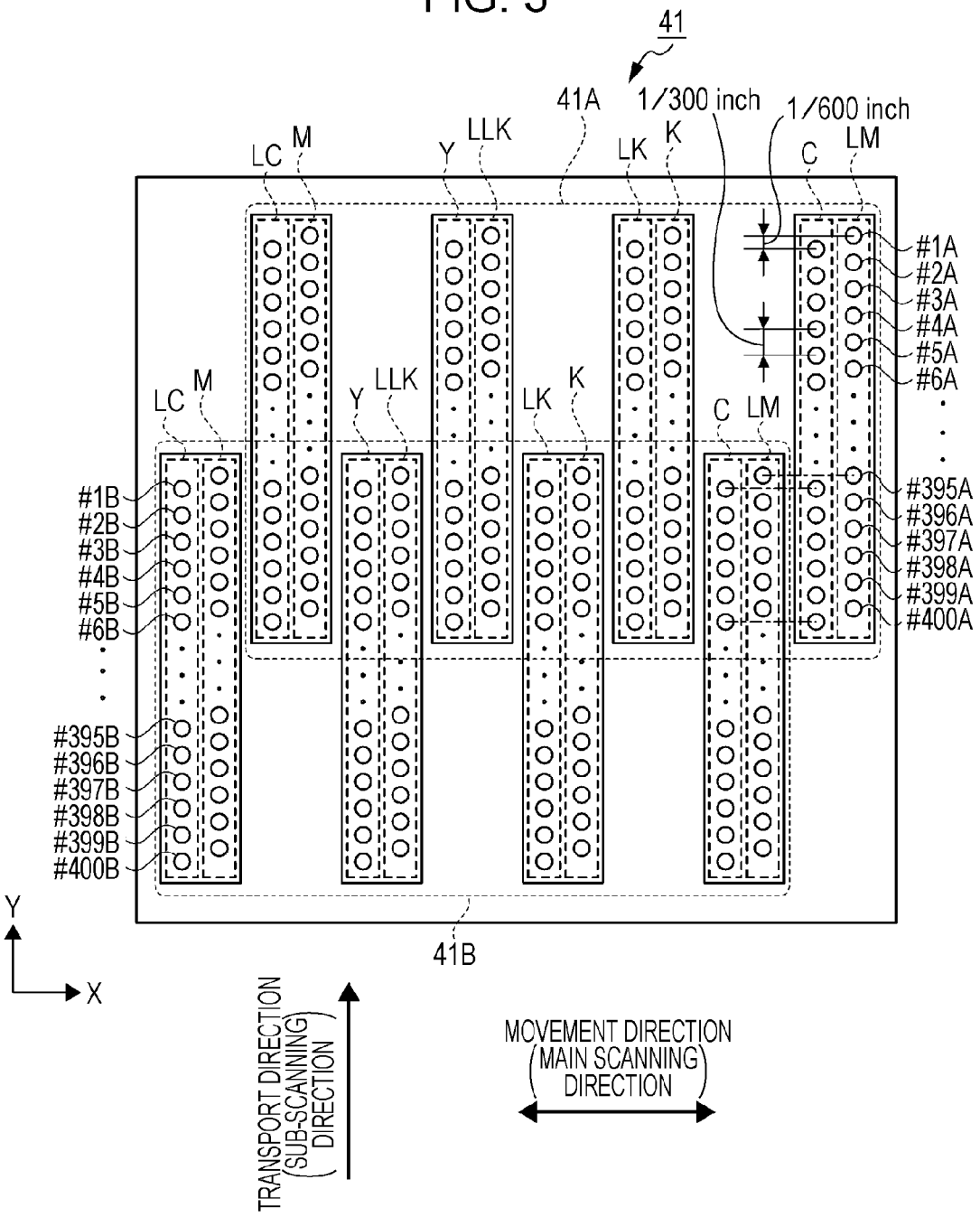
FIG. 3 is an explanatory view illustrating an example of the arrangement of the nozzles.

FIG. 3 is an explanatory view illustrating another example of the arrangement of the nozzles included in the head 41. In the example illustrated in FIG. 3, the head sets illustrated in FIG. 2 are arranged at closer positions. Specifically, in the example of FIG. 3, the first nozzle group 41A and the second nozzle group 41B are arranged so that groups of the two nozzle rows are alternately lined up. In addition, 400 nozzles (nozzles #1A to #400A or nozzles #1B to #400B) lined up in the sub-scanning direction at a nozzle pitch of 300 dpi are provided in each of the nozzle rows so that the two nozzle rows which form a group are arranged to be shifted from each other by a ½ pitch (1/600 inch).

Furthermore, the first nozzle group 41A and the second nozzle group 41B are provided so that the positions of 6 nozzles thereof in the sub-scanning direction overlap. For example, the position of the nozzle #395A of the first nozzle group 41A in the sub-scanning direction is the same as the position of the nozzle #1B of the second nozzle group 41B in the sub-scanning direction. Accordingly, when the nozzle #395A of the first nozzle group 41A can form a dot on a certain pixel during the droplet discharging operation, the nozzle #1B of the second nozzle group 41B can also form a dot on the pixel.

Method of Designating Nozzle Rows and Nozzles

Before describing a dot forming method, a method of designating the nozzle row and the nozzles will be described.

Figure 4:
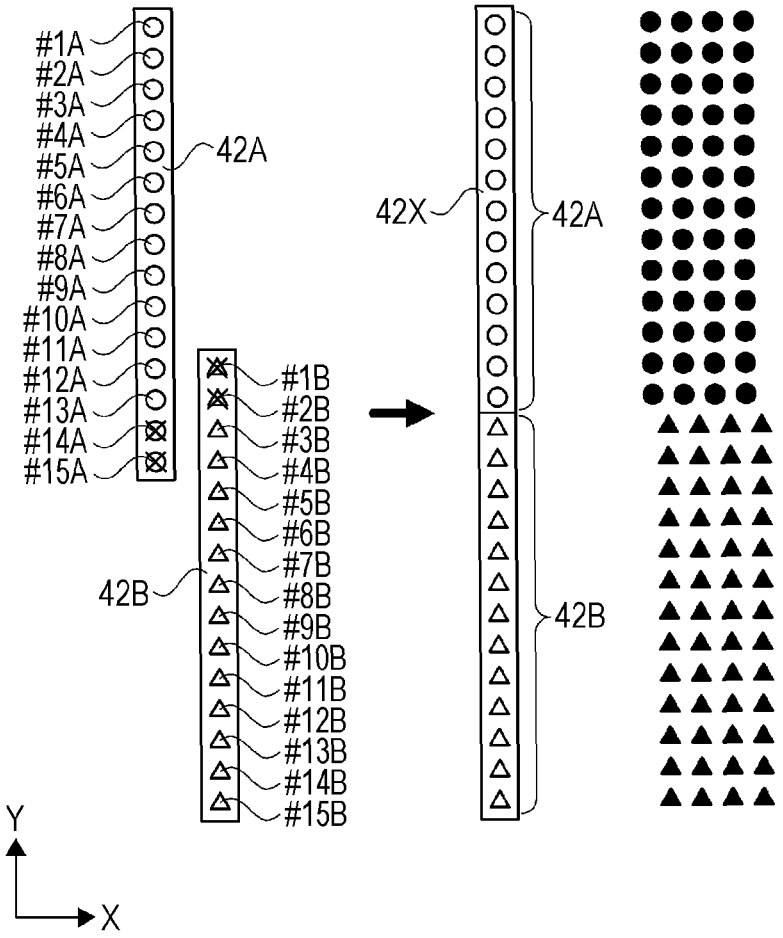
FIG. 4 is an explanatory view in which a head set is designated as a virtual head set.

FIG. 4 is an explanatory view in which a head set is designated as a virtual head set 42X.

On the left of FIG. 4, for example, the nozzle row for the dark black of the first nozzle group 41A and the nozzle row for the same dark black of the second nozzle group 41B are illustrated. In the following description, the nozzle row for the dark black of the first nozzle group 41A is called a first head 42A, and the nozzle row for the dark black of the second nozzle group 41B is called a second head 42B. For the simplification of the description, the number of nozzles in each of the nozzle rows is set to 15.

The positions in the sub-scanning direction of four nozzles (nozzles #12A to #15A) of the first head 42A on the upstream side in the sub-scanning direction and four nozzles (nozzles #1B to #4B) of the second head 42B on the downstream side in the sub-scanning direction overlap. In the following description, the four nozzles of each of the nozzle rows are called overlapping nozzles.

Each of the nozzles of the first head 42A is marked with a circle, and each of the nozzles of the second head 42B is marked with a triangle. In addition, the nozzle which does not discharge ink (that is, the nozzle which does not form a dot) is indicated by an X mark.

Here, among the overlapping nozzles of the first head 42A, the nozzle #12A and the nozzle #13A discharge ink, and the nozzle #14A and the nozzle #15A do not discharge ink. In addition, among the overlapping nozzles of the second head 42B, the nozzle #1B and the nozzle #2B do not discharge ink, and the nozzle #3B and the nozzle #4B discharge ink.

In this case, as illustrated at the center of FIG. 4, the two heads (the first head 42A and the second head 42B) constituting the head set may be designated as a single virtual head set 42X. In the following description, instead of illustrating the two heads separately, a mode of forming dots using the single virtual head set 42X will be described.

As illustrated on the right of FIG. 4, in the virtual head set 42X, even when the nozzles marked with the circles form dots on odd-numbered dots (described later), the nozzles marked with the triangles can form dots on even-numbered dots (described later). As a matter of course, in the case where the nozzles marked with the circles form dots on odd-numbered dots, the nozzles marked with the triangles can also form dots on odd-numbered dots.

The operation of forming dots by discharging the ink droplets from the individual nozzles is performed on the basis of the printing data received by the controller 60. However, for the simplification of the description, the description of the presence or absence of a discharging operation based on individual printing data is omitted. That is, a state where dots are formed at all the positions where the dots can be formed by discharging ink droplets from the corresponding nozzles based on the printing data will be basically described.

Dot Forming Method by Normal Process

Figure 5:
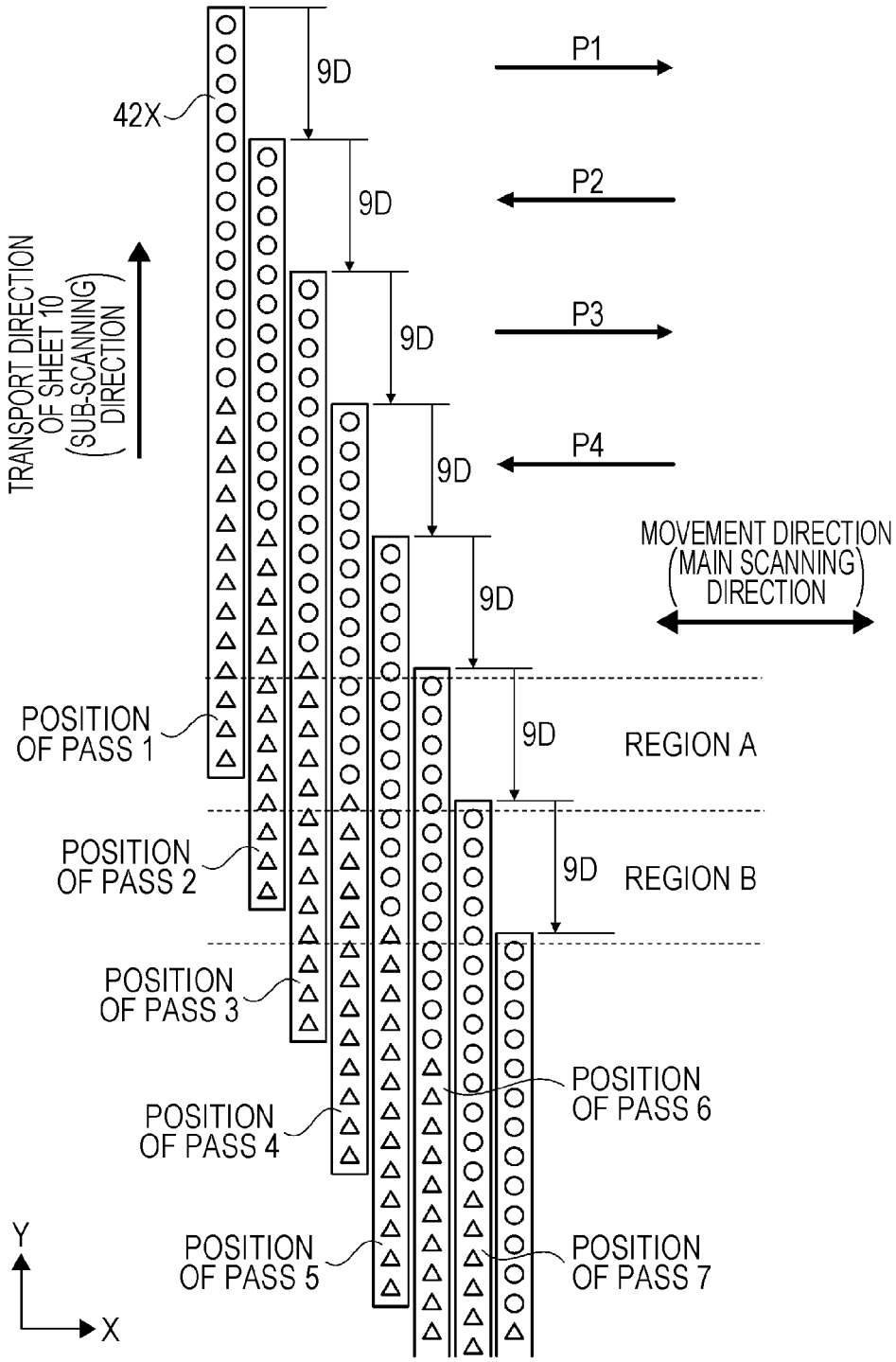
FIG. 5 is an explanatory view of an example of a normal process.

FIG. 5 is an explanatory view of an example of a normal process. The normal process is a process (the droplet discharging operation and the transporting operation) which is performed in a case of printing on the center portion of the sheet 10 (a region which is neither the upper end portion nor the lower end portion in the sheet 10). The controller 60 performs the normal process described below by controlling each of the units.

In FIG. 5, the relative positions of the virtual head set 42X due to step movements of the sheet 10 by the transporting unit 20 by a transport amount 9D are illustrated in an inclined direction so as not to overlap. That is, in FIG. 5, the virtual head set 42X is illustrated to move with respect to the sheet 10. However, actually, the sheet 10 moves in the sub-scanning direction. In addition, in FIG. 5, the relationship between the positions of the virtual head set 42X in the X direction is not significant. Arrows P1 to P4 represent directions in which the virtual head set 42X performs scanning in the main scanning direction (the X-axis direction).

In the normal process, the sheet 10 is transported in the transporting operation performed between passes by a transport amount 9D of 9 dots. For example, dots are formed on a region A of FIG. 5 (a region on the sheet 10) in passes 1 to 6, and dots are formed on a region B by passes 2 to 7.

In an odd-numbered pass, each of the nozzles is positioned, for example, in an odd-numbered raster line (the row of dots along the main scanning direction). After the odd-numbered pass, in order to perform an even-numbered pass after the sheet 10 is transported by the transport amount 9D of 9 dots, each of the nozzles is positioned in an even-numbered raster line in the even-numbered pass. As described above, the position of each of the nozzles is alternately located in the odd-numbered and the even-numbered raster line in each pass.

Figure 6:
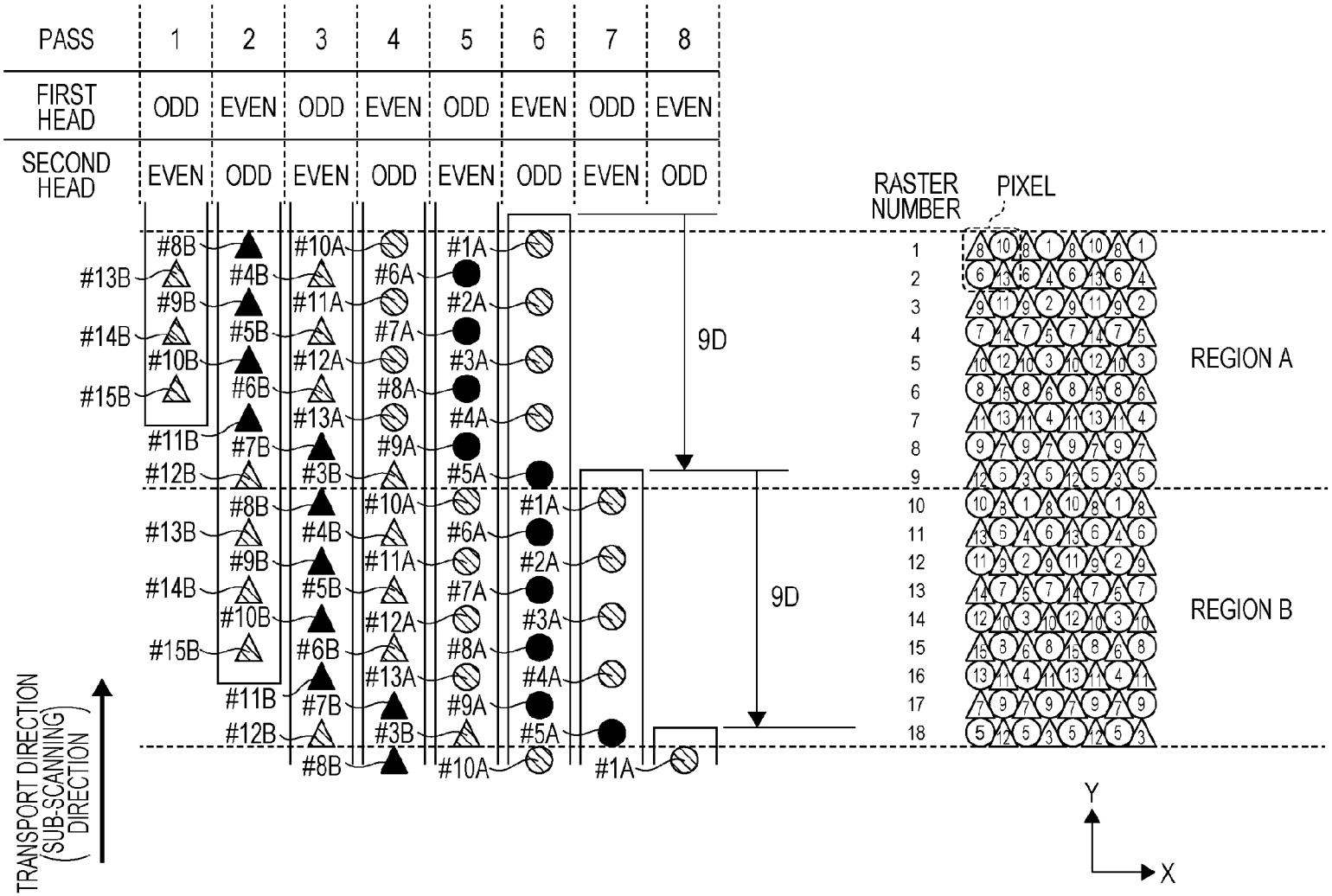
FIG. 6 is an explanatory view of an example of dot formation in the normal process.

FIG. 6 is an explanatory view of an example of the dot formation in the region A and the region B of FIG. 5. Here, in FIG. 6, for example, a case where a single pixel is formed by 4 dots which are adjacent to each other vertically and horizontally is illustrated.

On the left of FIG. 6, the relative positions of the nozzles in each pass are illustrated. The black nozzle forms dots at a ratio of one dot to one pixel in the pass. For example, the nozzle #8B of the pass 2 forms dots at a ratio of one dot to two dot positions. The hatched nozzle forms dots at a ratio of one dot to two pixels. For example, the nozzle #10A of the pass 4 forms dots at a ratio of one dot to four dot positions.

The hatched nozzle forms dots at a ratio of only half of that of the black nozzle. Hereinafter, the hatched nozzle is called a POL nozzle. The positions in the sub-scanning direction of four nozzles (nozzles #10A to #13A) of the first head 42A on the upstream side (−Y side) in the sub-scanning direction in a certain pass and four nozzles (nozzles #1A to #4A) of the first head 42A on the downstream side (+Y side) in the sub-scanning direction after performing the transporting operation twice from the pass overlap. Such nozzles are the POL nozzles. For example, the positions in the sub-scanning direction of the nozzles #10A to #13A in the pass 4 and the nozzles #1A to #4A in the pass 6 overlap, and thus the nozzles are the POL nozzles.

In the same manner, the positions in the sub-scanning direction of four nozzles (nozzles #12B to #15B) of the second head 42B on the upstream side in the sub-scanning direction in a certain pass and four nozzles (nozzles #3B to #6B) of the second head 42B on the downstream side in the sub-scanning direction after performing the transporting operation twice from the pass overlap. These nozzles are the POL nozzles. For example, the positions in the sub-scanning direction of the nozzles #12B to #15B in the pass 2 and the nozzles #3B to #6B in the pass 4 overlap, and thus the nozzles are the POL nozzles.

On the right of FIG. 6, the nozzles which form dots in each pixel are illustrated. For example, a first raster line (a line of which the raster number is 1) is constituted by dots formed on odd-numbered dots by the nozzle #8B and dots formed on even-numbered dots by the nozzle #10A and the nozzle #1A. Here, for the simplification of the description, each of the raster lines is constituted only by 8 dots.

On the upper left of FIG. 6, the positions of dots formed by each of the heads are illustrated. For example, in the pass 1, the nozzles (nozzles #1A to 13A) of the first head 42A form dots on the odd-numbered dots, and the nozzles (nozzles #3B to #15B) of the second head 42B forms dots on the even-numbered dots.

Each of the raster lines is constituted by dots which are formed by two or three nozzles. In other words, two or three nozzles correspond to each of the raster lines. For example, the nozzle #8B in the pass 2, the nozzle #10A in the pass 4, and the nozzle #1A in the pass 6 correspond to the $1^{st}$ raster line. Each of the raster lines is constituted by dots formed by at least one nozzle of the first head 42A and dots formed by at least one nozzle of the second head 42B. In other words, at least one nozzle of the first head 42A and at least one nozzle of the second head 42B correspond to each of the raster lines.

In a case where only a single nozzle corresponds to the odd-numbered dots or the even-numbered dots of a certain raster line, the nozzle forms dots at a ratio of one dot to two dots. For example, one nozzle #8B corresponds to the odd-numbered dots of the $1^{st}$ raster line (other nozzles do not correspond thereto). Therefore, the nozzle #8B forms dots at a ratio of one dot to two dots.

On the other hand, in a case where two nozzles correspond to the odd-numbered dots or the even-numbered dots of a certain raster line, each of the two nozzles forms dots at a ratio of one dot to four dots (becomes the POL nozzle). For example, the nozzle #10A and the nozzle #1A correspond to the even-numbered dots of the $1^{st}$ raster line. Therefore, each of the nozzle #10A and the nozzle #1A forms dots at a ratio of one dot to four dots (becomes the POL nozzles).

In the normal process, in a certain pass, the positions (the position in the main scanning direction) where the first head 42A forms dots are different from the positions where the second head 42B forms dots. Specifically, in a case where the first head 42A forms dots on the odd-numbered dots, the second head 42B forms dots on the even-numbered dots. On the contrary, in a case where the first head 42A forms dots on the even-numbered dots, the second head 42B forms dots on the odd-numbered dots. Since the above-described first drive signal generating unit 65A and second drive signal generating unit 65B independently generate the drive signals, such dot formation is possible.

Moreover, in the normal process, in comparison between a certain pass and the subsequent pass, the positions where each of the heads forms dots differ. For example, in a case where the first head 42A forms dots on the odd-numbered dots and the second head 42B forms dots on the even-numbered dots in a certain pass, the first head 42A forms dots on the even-numbered dots and the second head 42B forms dots on the odd-numbered dots in the subsequent pass.

By forming dots in this manner, dots are formed by one head in a zigzag pattern, and to fill the spaces between the dots of the zigzag pattern, dots are formed by the other head in a zigzag pattern. Focusing on the right of FIG. 6, the circle-marked dots which are formed by the first head 42A have a zigzag pattern, and the triangle-marked dots which are formed by the second head 42B also have a zigzag pattern. As the dot formation order, after dots are formed by the second head 42B in a zigzag pattern, dots are formed by the first head 42A to fill the spaces therebetween.

In a case where a raster line is formed in the normal process, half of the dots in the raster line are formed by the first head 42A, and the other half are formed by the second head 42B. In other words, in a case of forming the raster line, the head use ratio of the first head 42A is 50% (constant), and the head use ratio of the second head 42B is also 50% (constant).

Since the dots of the region A are formed in the passes 1 to 6 and the dots of the region B are formed in the passes 2 to 7, the passes of the region A and the region B are shifted by one pass. Since the passes are shifted by one pass, the nozzles corresponding to the raster lines are common to the regions. However, the position (the position in the main scanning direction) of the dot formed by each nozzle is different between the odd-numbered dot and the even-numbered dot. For example, in the $1^{st}$ raster line, the nozzle #8B in the pass 2 forms dots on the odd-numbered dots. However, in the $10^{th}$ raster line, the nozzle #8B in the pass 3 forms dots on the even-numbered dots.

Although not illustrated herein, in the $19^{th}$ to $27^{th}$ raster lines positioned closer to the upstream side in the sub-scanning direction than the region B, dots which are substantially the same as those in the region A are formed in the passes 3 to 8. For example, the nozzle #8B, the nozzle #10A, and the nozzle #1A correspond to the $19^{th}$ raster line, and the nozzle #8B forms dots on the odd-numbered dots in the 19th raster line. In addition, in the $28^{th}$ to $36^{th}$ raster lines positioned closer to the upstream side in the sub-scanning direction than the $19^{th}$ to $27^{th}$ raster lines, dots which are substantially the same as those in the region B are formed in the passes 4 to 9. When the normal process is continuously performed in this manner, dot formation performed on the region A and the region B is repeated.

For example, in a case where a high-definition image is formed on the sheet 10 by forming dots on the sheet 10, the sheet 10 needs to be reliably held at a predetermined position (and height) during the droplet discharging operation, and the sheet 10 needs to be accurately moved to a predetermined position during the transporting operation. Therefore, the transporting unit 20 fixes (holds) the sheet 10 by, for example, interposing, pressing, and absorbing units and the like. The fixing (holding) unit needs to be configured so as not to interfere with the movement of the carriage unit 30, the head unit 40, and the like. In other words, the fixing (holding) unit is configured so that printing even on the upper end portion and the lower end portion of the sheet 10 is started and ended in a reliably fixed (held) state (position) of the sheet 10. As a result, for example, in the configuration in which the first nozzle group 41A and the second nozzle group 41B which have the nozzle rows lined up in the sub-scanning direction (Y direction) are lined up in the sub-scanning direction (Y direction) as in this embodiment, there may be a case where dots have to be formed on each of the upper end portion and the lower end portion of the sheet 10 only by the corresponding nozzles of the corresponding head (the first head 42A or the second head 42B).

Dot Forming Method by Upper End Process (Related Art)

Hereinafter, an example of an upper end process according to the related art in a case where an image subjected to POL control between a plurality of heads may not be formed will be described. The upper end process is a process (the droplet discharging operation and the transporting operation) performed in a case where the upper end region (the region on the +Y side) of the sheet 10 is printed. The controller 60 performs the upper end process described below by controlling each of the units.

Figure 7A:
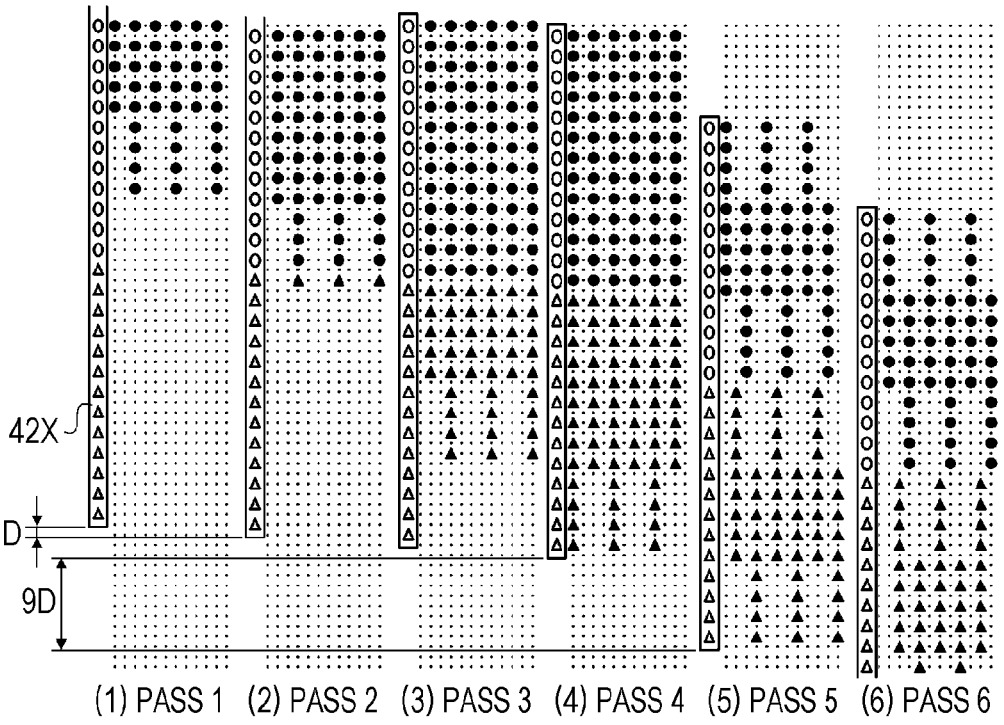
FIGS. 7A and 7B are explanatory views of an example of an upper end process according to the related art.
Figure 7B:
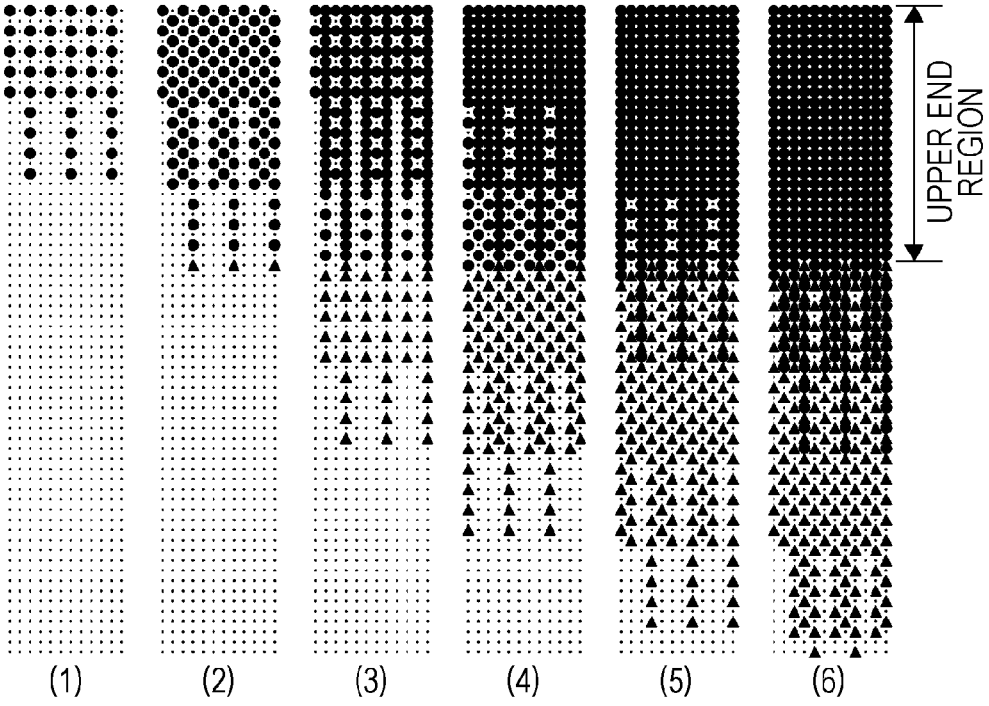

FIGS. 7A and 7B are explanatory views of an example of the upper end process according to the related art. (1) to (4) of FIG. 7A illustrate the positions of the virtual head set 42X and the discharged ink droplets in each of the passes (passes 1 to 4) of the upper end process. (5) and (6) of FIG. 7A illustrate the positions of the virtual head set 42X and the discharged ink droplets in each of the passes (passes 5 and 6) of the normal process which follows the upper end process.

(1) to (6) of FIG. 7B illustrate dots formed on the sheet 10 in the passes 1 to 6. That is, the result of overlapping the positions of the ink droplets in (1) to (6) of FIG. 7A is illustrated in (1) to (6) of FIG. 7B.

In the example illustrated herein, the upper end process is performed in the passes 1 to 4, and the normal process is performed in the pass 5 and the subsequent passes. In the upper end process, the sheet 10 is transported by a transport amount D of one dot (a transport amount which is smaller than the transport amount 9D in the normal process) in the transporting operation which is performed between the passes.

In the upper end process, each of the nozzles is positioned in the odd-numbered raster line in the odd-numbered pass. After the odd-numbered pass, the sheet 10 is transported by the transport amount of one dot, and thus each of the nozzles is positioned in the even-numbered raster line in the even-numbered pass. As described above, even in the upper end process, the position of each of the nozzles is alternately located in the odd-numbered and even-numbered raster line in each pass.

In the above-described normal process, in order to form dots in a zigzag pattern by each of the heads, the dot formation position of the first head 42A and the dot formation position of the second head 42B are different from each other in a certain pass. For example, in a case where the first head 42A forms dots on the odd-numbered dots, the second head 42B forms dots on the even-numbered dots.

On the contrary, in the upper end process, the dot formation position of the first head 42A and the dot formation position of the second head 42B are the same in a certain pass. For example, in the pass 1, both the first head 42A and the second head 42B form dots on the odd-numbered dots.

In addition, in the above-described normal process, in order to form dots in a zigzag pattern by each of the heads, the dot formation positions of each of the heads are different between a certain pass and the subsequent pass. For example, in a case where the first head 42A forms dots on the odd-numbered dots and the second head 42B forms dots on the even-numbered dots in a certain pass, the first head 42A forms dots on the even-numbered dots and the second head 42B forms dots on the odd-numbered dots in the subsequent pass.

On the contrary, in the upper end process, the dot formation position of each of the heads is changed in the order of the odd-numbered dots (pass 1), the even-numbered dots (pass 2), the even-numbered dots (pass 3), and the odd-numbered dots (pass 4). That is, in the upper end process, the dot formation positions of each of the heads are not necessarily different between a certain pass and the subsequent pass. For example, the dot formation positions in the pass 2 and the pass 3 are on the same even-numbered dots.

The reason why there is the above-described difference between the normal process and the upper end process is that dots are formed in a zigzag pattern in the two passes as the first half of the four passes and to fill the spaces between the dots in the zigzag pattern, dots are formed in a zigzag pattern in the two passes as the second half in the upper end process, while dots are formed by each of the head in a zigzag pattern in the normal process.

By the above-described dot forming method, $1^{st}$ to $25^{th}$ raster lines (raster lines on the upper end side of the sheet 10) are formed only by the first head 42A. In other words, when the $1^{st}$ to $25^{th}$ raster lines are formed, the head use ratio of the first head 42A is 100%, and the head use ratio of the second head 42B is 0%.

Figure 8:
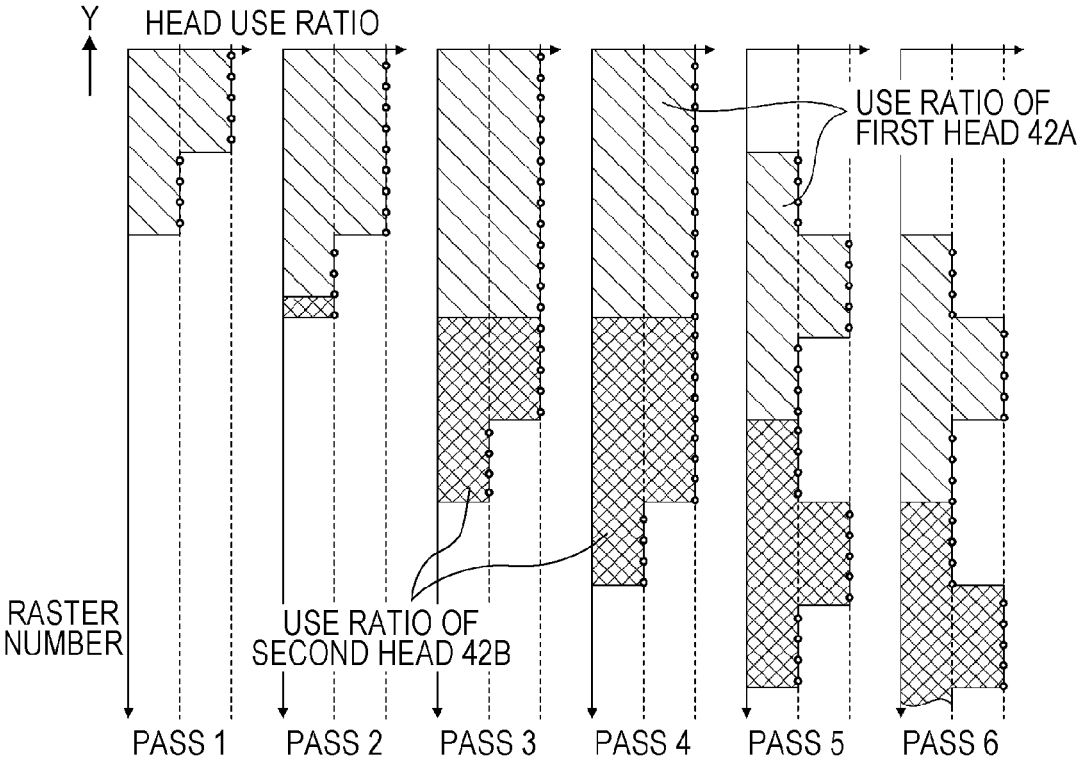
FIG. 8 is a graph schematically illustrating the use ratios of heads in passes 1 to 6.

FIG. 8 is a graph schematically illustrating the use ratios of the first head 42A and the second head 42B in each of the passes (the passes 1 to 6).

Hereinabove, for ease of understanding, a range in which dots can be visually recognized is illustrated for the description. Therefore, as illustrated in FIG. 8, a change (difference in the raster number direction) in the use ratio of each of the heads is illustrated in a stepped manner. However, in the actual use, an image is formed by a countless number of dots formed by several picoliters of ink droplets, and thus the change in the use ratio of each of the heads can be illustrated by an approximation to a straight line or a curve.

Figure 9A:
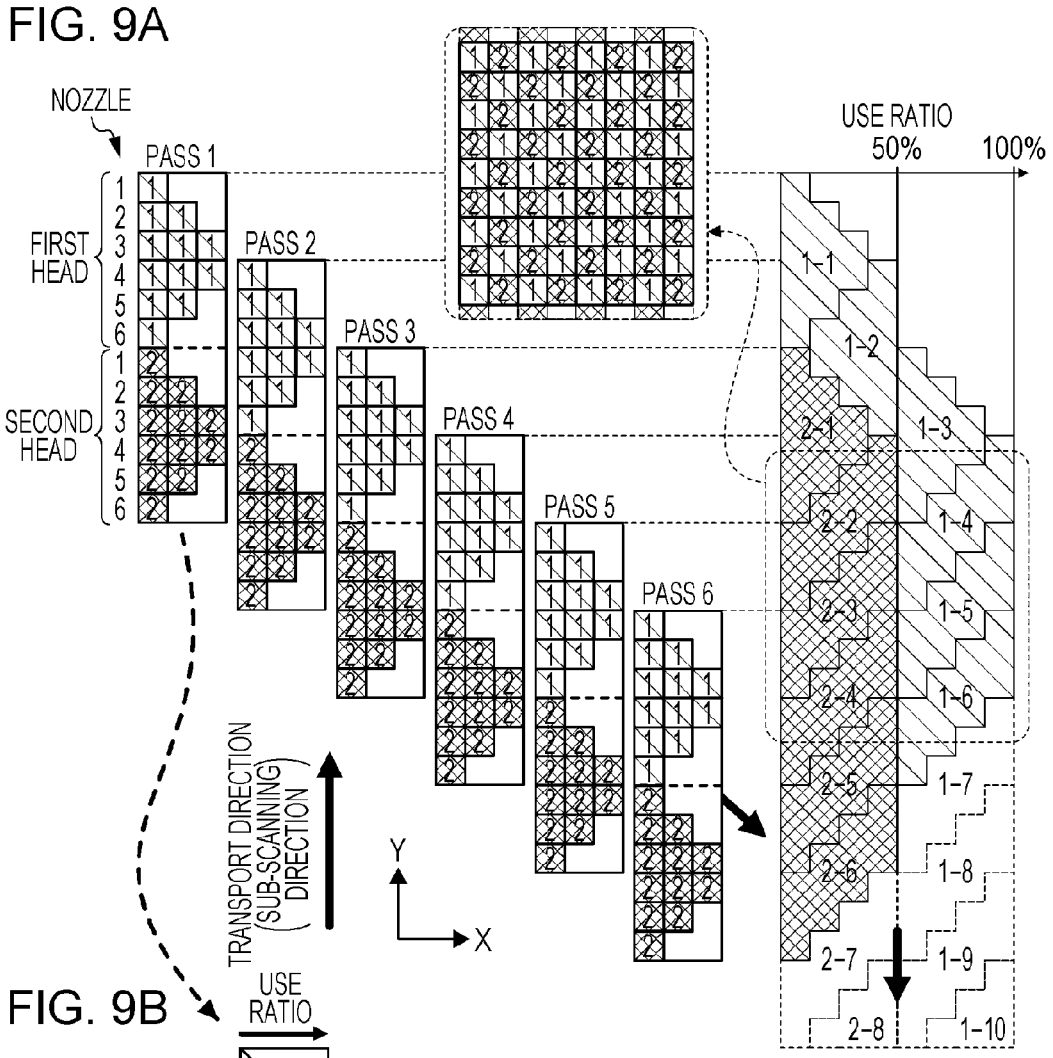
FIGS. 9A and 9B are explanatory views of a case where head use ratios are illustrated by a linear approximation.
Figure 9B:
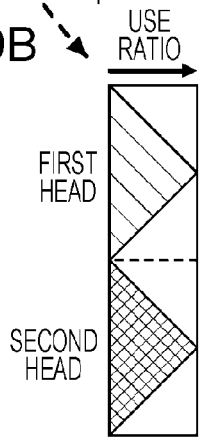

FIGS. 9A and 9B are explanatory views illustrating a case where the head use ratios are illustrated by a linear approximation.

For example, FIG. 9A illustrates the normal process in which three dots are formed at the maximum per nozzle in one pass by using two heads each having six nozzles. In the normal process, as illustrated on the right of FIG. 9A, a solid pattern in which four dots are formed by each of the heads, that is, the use ratio of each of the heads is 50% (the arrangement of dots has a zigzag pattern as illustrated on the upper part of FIG. 9A) is formed.

In a case where an image is formed by a countless number of dots formed by several picoliters of ink droplets, the number of dots is substituted with the use ratio of each of the nozzles, and blocks which are stacked in a pyramid form illustrated in each of the passes of FIG. 9A may be expressed as a triangle shape (or a trapezoid shape) illustrated in FIG. 9B.

Hereinafter, the distribution of the use ratios of the nozzles in each of the passes (that is, the use ratio of each of the heads in each raster line) is described by the expression using the triangle shape (or the trapezoid shape).

Dot Forming Method by Lower End Process (Related Art)

Hereinafter, an example of an lower end process according to the related art in a case where an image subjected to POL control between a plurality of heads may not be formed will be described. The lower end process is a process (the droplet discharging operation and the transporting operation) performed in a case where the lower end region (the end portion region on the −Y side) of the sheet 10 is printed.

The basic idea for the lower end process is the same as the upper end process described above. That is, the lower end process may be performed in the reverse order to the upper end process. Here, the upper end process can be started in a state where the positional relationship between the upper end of the sheet 10 and the head 41 (the first head 42A and the second head 42B) is constant. However, in the lower end process, the position of the head 41 which moves steps and the lower end position of the sheet 10 are different from each other depending on the size of the sheet 10, and thus the end position in the lower end process needs to be aligned with the lower end of the sheet 10.

Therefore, the controller 60 detects the lower end position of the sheet 10 which moves steps, and performs the lower end process described below by controlling each of the units. The detection of the lower end position of the sheet 10 is performed by using an optical sensor (not illustrated) or the like.

Figure 10:
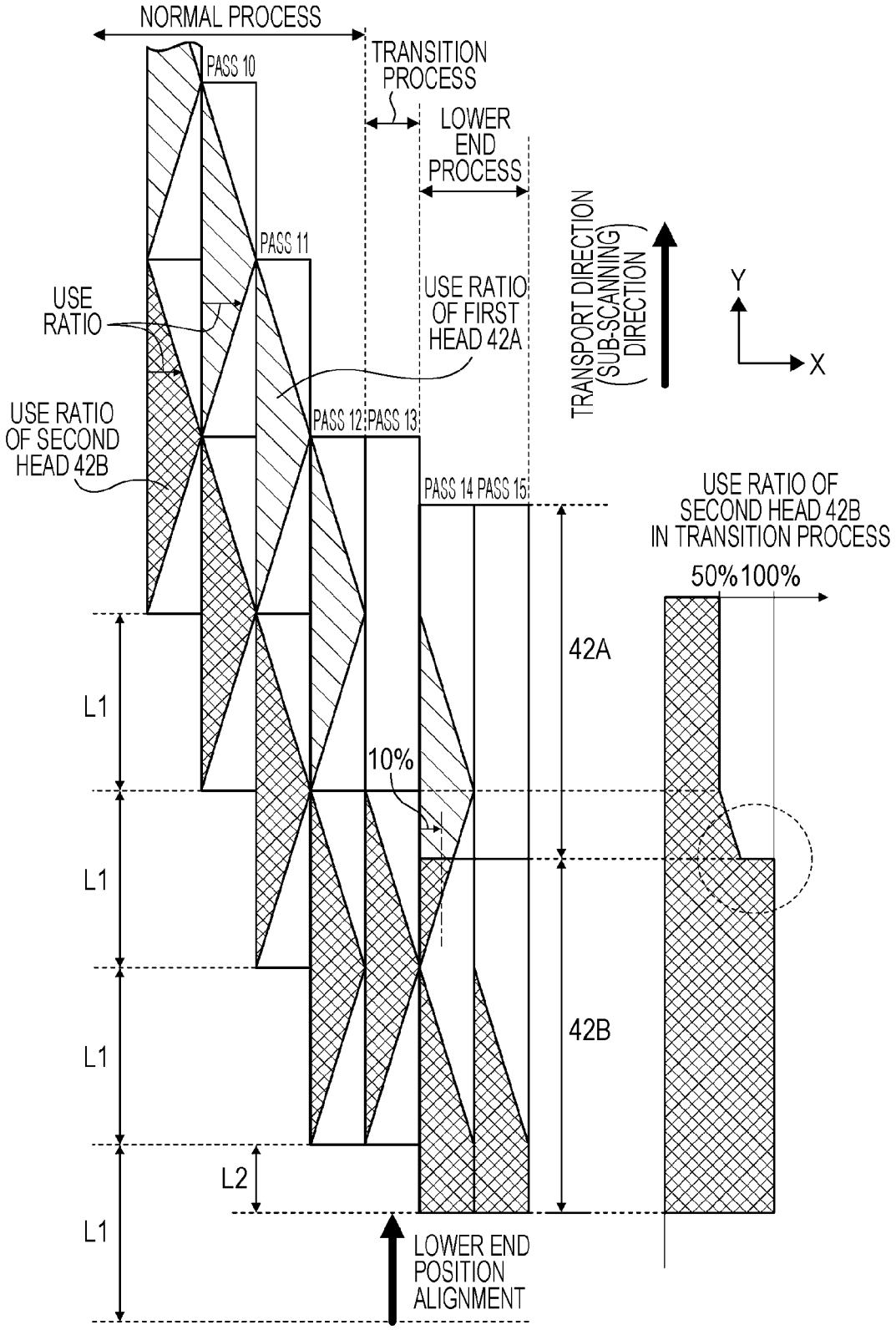
FIG. 10 is a graph illustrating head use ratios in a lower end process according to the related art.

FIG. 10 is a graph illustrating the head use ratio of each of the first head 42A and the second head 42B in the lower end process according to the related art.

In FIG. 10, the head set formed by the first head 42A and the second head 42B is designated as a single row of the first head 42A and the second head 42B lined up in the Y direction similarly to the virtual head set 42X illustrated in FIG. 4. In addition, similarly to FIG. 5, the relative positions of the first head 42A and the second head 42B due to movements of the sheet 10 by the transporting unit 20 are illustrated to be arranged in an inclined direction so as not to overlap. That is, in FIG. 10, the first head 42A and the second head 42B are illustrated to move with respect to the sheet 10. However, actually, the sheet 10 moves in the sub-scanning direction (the Y direction). In FIG. 10, the relationship between the positions of the first head 42A and the second head 42B in the X direction is not significant. The use ratio of each of the heads (the use ratio of the nozzles that belong to each of the heads in each raster line) is illustrated in the same manner as FIG. 9B.

An example illustrated in FIG. 10 illustrates, for example, a case where the pass 12 and the preceding passes are subjected to the normal process in which each of the use ratios of the first head 42A and the second head 42B is 50% when the passes overlap, the pass 13 is subjected to the transition process, and the passes 14 and 15 are subjected to the lower end process in which the lower end portion is printed. A transport amount L1 of the step movement in the normal process is set to be half the length of the first head 42A or the second head 42B. Specifically, for example, the step movement by the length of 89 nozzles in the head 41 illustrated in FIG. 2 is performed.

The normal process is performed until the pass 12, and is transitioned to the transition process by control of the controller 60 which detects that a transport amount corresponding to the transport amount L1 does not remain, using the optical sensor that detects the lower end position of the sheet 10. First, in the transition process (the pass 13), the droplet discharging operation is performed by the second head 42B without step transport, step movement by a transport amount L2 that remains is performed, and the droplet discharging operation is performed in the lower end process (the passes 14 and 15) on the parts that remain until the pass 13 under the POL control.

However, in the lower end process according to the related art, although the process of increasing the use ratio of the second head 42B is performed while the POL control is performed between the passes by the transition process and the lower end process, when viewed in each raster line, as illustrated on the right of FIG. 10, there may be a case where a part (a part marked with a dashed circle) in which the use ratio of the second head 42B rapidly increases is present. Therefore, in a case where the nozzles constituting the first head 42A and the nozzles constituting the second head 42B have different discharge characteristics, the effect thereof becomes significant. Specifically, for example, in a case where the opening diameter of the nozzle provided in the second head 42B is larger than that of the first head 42A due to manufacturing variations, the discharged droplet increases in size, resulting in a difference in concentration due to a change in the use ratio of the second head 42B. In this embodiment, this is improved by the method described below.

Lower End Process in This Embodiment

Example 1

Figure 11:
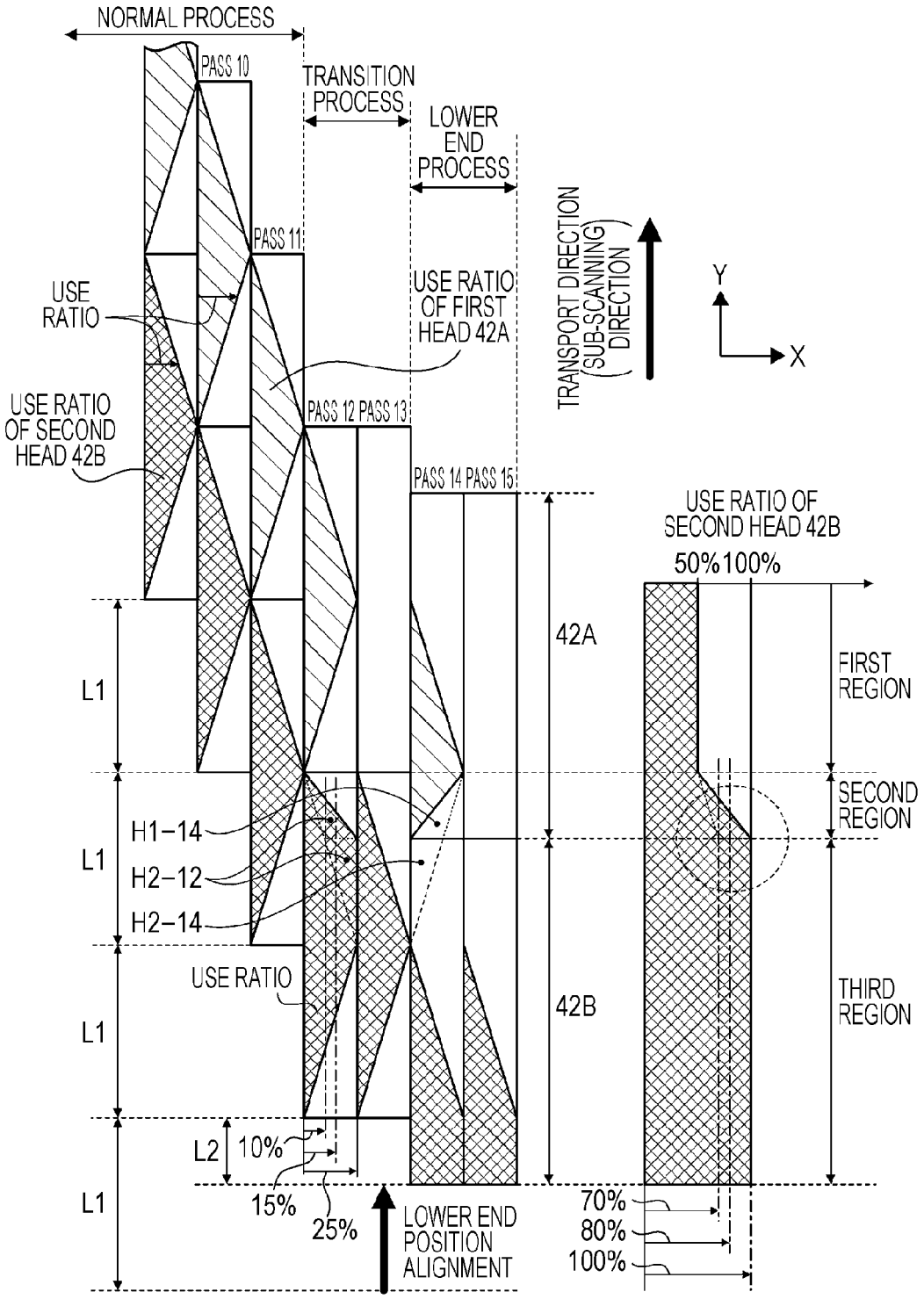
FIG. 11 is a graph illustrating the head use ratio of each of a first head and a second head in Example 1.

FIG. 11 is a graph illustrating the head use ratio of each of the first head 42A and the second head 42B which are provided in the ink jet printer 100. A droplet discharging method as an example (Example 1) of the exemplary embodiment of the invention will be described with reference to FIG. 11.

In FIG. 11, similarly to FIG. 10, the head set formed by the first head 42A and the second head 42B is designated as a single row of the first head 42A and the second head 42B lined up in the Y direction similarly to the virtual head set 42X illustrated in FIG. 4. In addition, similarly to FIG. 5, the relative positions of the first head 42A and the second head 42B due to movements of the sheet 10 by the transporting unit 20 are illustrated to be arranged in an inclined direction so as not to overlap. That is, in FIG. 11, the first head 42A and the second head 42B are illustrated to move with respect to the sheet 10. However, actually, the sheet 10 moves in the sub-scanning direction (the Y direction). In FIG. 11, the relationship between the positions of the first head 42A and the second head 42B in the X direction is not significant. The use ratio of each of the heads (the use ratio of the nozzles that belong to each of the heads in each raster line) is illustrated in the same manner as FIG. 9B.

The ink jet printer 100 performs the transition process from the normal process and the lower end process when printing on the lower end region of the sheet 10. As a result, a region of the sheet 10 in which dots are formed is divided into three types of regions, which are a first region, a second region that is positioned in the −Y direction from the first region to be connected to the first region, and a third region that is positioned in the −Y direction from the second region to be connected to the second region by the difference between the use ratios of the first head 42A and the second head 42B. In other words, even though the characteristics of the heads vary, the three divided regions are provided to have different head use ratios so that it becomes difficult to visually recognize the influence of the variation.

The first region is a region formed by the normal process, and dots are formed thereon by using the first head 42A and the second head 42B to cause the second head use ratio to be constant (50%).

Dots are formed on the second region by using the first head 42A and the second head 42B so that, when the ratio of the number of dots formed by using the second head 42B to the sum of the number of dots formed by using the first head 42A and the number of dots formed by using the second head 42B is referred to as a second head use ratio in the rows of dots (raster lines) which are lined up in the X direction, the second head use ratio is increased from a value less than a first set value to a value greater than a second set value greater than the first set value in the −Y direction in the plurality of rows of dots (that is, over the plurality of raster lines) lined up in the X direction. Specifically, the first set value is 70%, and the second set value is 80%.

Dots are formed on the third region only by using the second head 42B.

Hereinafter, this will be described in detail.

As illustrated in FIG. 11, the transition process is performed in the passes 12 and 13, and the lower end process is performed in the passes 14 and 15.

The difference from the related art illustrated in FIG. 10 is that dots (H2-12) of a part (H2-14 illustrated FIG. 11) in which dots are formed by the second head 42B in the pass 14 which contributes to the part (the part indicated by a dashed circle of FIG. 10) in which the use ratio of the second head 42B is rapidly increased and a part (H1-14) in which dots are formed by the first head 42A in the pass 14 are formed in the pass 12.

In other words, in the transition process (the passes 12 and 13) and the lower end process (the passes 14 and 15), when the ratio of the number of dots formed in one pass by using the second head 42B to the sum of the number of dots formed by using the first head 42A and the number of dots formed by using the second head 42B is referred to as a second head one pass use ratio in each of the raster lines formed in each of the passes, the second head one pass use ratio is distributed as follows.

In the plurality of rows of dots (that is, the plurality of raster lines formed in one pass) lined up in the X direction, which are formed in one pass by the plurality of nozzles provided in the second head 42B, the second head one pass use ratio is increased from a value less than a third set value to a value greater than a fourth set value greater than the third set value in the −Y direction and is decreased from the value greater than the fourth set value to a value less than the third set value. Specifically, the third set value is 10%, and the fourth set value is 15%.

That is, as illustrated in FIG. 11, in the passes 12 and 15, the number of dots formed in one pass is increased from a value less than 10% to a value greater than 15% in the −Y direction, and is decreased from the value greater than 15% to a value less than 10%. More specifically, the second head one pass use ratio is set to be increased from 0% to 25% and to be decreased to 0%.

On the contrary, in the related art, in the pass 14 illustrated in FIG. 10, the second head 42B is used so that the second head one pass use ratio is suddenly decreased from the value greater than 10%. Due to the above influence, even in a state where printing is completed (a state where the pass 15 is completed), as illustrated on the right of FIG. 10, the part (the part indicated by the dashed circle) in which the use ratio of the second head 42B rapidly increases is shown.

On the right of FIG. 11, the graph of the use ratio of the second head 42B is illustrated as a result of overlapping the use ratios (the passes before the pass 10 to the pass 15).

The first region in which the first head 42A and the second head 42B are used by 50% each, the second region which is formed by using first head 42A and the second head 42B to cause the use ratio of the second head 42B to be increased from 50% to 100% in the −Y direction in each raster line, and the third region which is formed only by using the second head 42B are formed.

As described above, according to the droplet discharging method and the droplet discharging apparatus in this embodiment, the following effects can be obtained.

The first region is formed of dots by using the first head 42A and the second head 42B to cause the second head use ratio to be constant (50%).

The second region which is positioned in the −Y direction from the first region to be connected to the first region is formed of dots by using the first head 42A and the second head 42B so that the second head use ratio increases from a value less than the first set value (70%) to a value greater than the second set value (80%) in the −Y direction in the plurality of rows of dots (the plurality of raster lines) lined up in the X direction.

The third region which is positioned in the −Y direction from the second region to be connected to the second region is formed of dots by using the second head 42B.

That is, the second region is positioned between the first region which is formed of dots by using the first head 42A and second head 42B to cause the second head use ratio to be constant and the third region which is formed of dots only by using the second head 42B. The second region is configured as a region in which the second head use ratio increases from the value less than the first set value to the value greater than the second set value greater than the first set value in the −Y direction (that is, in a direction from the first region to the third region).

As a result, for example, even in a case where there is a difference between the characteristics (a characteristic of discharging droplets) of the first head 42A and the characteristics of the second head 42B, since the second region is configured so that the influence of the second head 42B having different characteristics gradually increases in the direction from the first region to the third region, the change therein becomes smooth. Specifically, for example, even in the case where the opening diameter of the nozzle provided in the second head 42B is larger than that of the first head 42A due to manufacturing variations, that is, as a result, even in a case where the discharged droplet increases in size and the individual dot diameter formed by the second head 42B increases, the influence thereof is not suddenly significantly exhibited due to the use of the second head 42B but a gradual increase is exhibited.

Accordingly, for example, even in a case where the partial overlap by the two heads including the first head 42A and the second head 42B cannot be performed, that is, even in a case where the POL control between the first head 42A and the second head 42B having different characteristics cannot be performed on the lower end portion of the sheet 10 or the like, the difference between the image region (the first region) subjected to the POL control between the first head 42A and the second head 42B and the image region (the third region) formed only by the second head 42B can be smoothly transitioned. As a result, the difference in the image by the heads having different characteristics is less likely to be visually recognized, and thus higher image quality can be achieved.

In the second region, in the plurality of rows of dots lined up in the X direction, which are formed in one pass by the plurality of nozzles provided in the second head 42B, the second head one pass use ratio is increased from a value less than the third set value (10%) to a value greater than the fourth set value (15%) in the −Y direction, and is decreased from the value greater than the fourth set value to a value less than the third set value.

That is, the second head one pass use ratio is increased from a value less than 10% to a value greater than 15% and is decreased from the value greater than 15% to a value less than 10% in the −Y direction in each of the passes, and the second region is formed by overlapping the passes. The second region which is formed by overlapping the passes is reliably configured as a region in which the second head use ratio increases from the value less than the first set value (70%) to the value greater than the second set value (80%) in the −Y direction (that is, in the direction from the first region to the third region). That is, for example, the second head use ratio does not suddenly become 100%, and thus the change therein becomes smooth.

In addition, since the sheet 10 is moved in the Y direction, the −Y direction is the lower end portion direction of the sheet 10. In a case where it is difficult to apply the POL control by the plurality of heads to the lower end portion, the second head 42B which is positioned in the −Y direction from the first head 42A is used to form dots on the lower end portion. According to this embodiment, for example, even in the case where there is a difference between the characteristics of the first head 42A and the characteristics of the second head 42B, the difference between the center portion region (the first region) subjected to the POL control between the first head 42A and the second head 42B and the lower end portion region (the third region) formed only by the second head 42B can be smoothly transitioned.

The first head 42A and the second head 42B are mounted in the carriage 31 as the head set and discharge droplets (ink droplets) having the same composition while moving in the X direction or in the −X direction along with the carriage 31. That is, the head set is used as a single head provided with a larger number of nozzles. According to this embodiment, even in the case where there is a difference in characteristics between the first head 42A and the second head 42B which constitute the head set, higher image quality in which deterioration of the image caused by the difference is less likely to be visually recognized can be achieved.

In addition, a plurality of head sets are mounted in the carriage 31, and droplets have different compositions according to the head sets. For example, even in a case where there is a difference in characteristics between the first head 42A and the second head 42B which constitute each of the plurality of head sets, since ink that expresses full-color is contained, higher quality full-color image in which deterioration of the image caused by the difference is less likely to be visually recognized can be achieved.

Lower End Process in This Embodiment

Example 2

Figure 12:
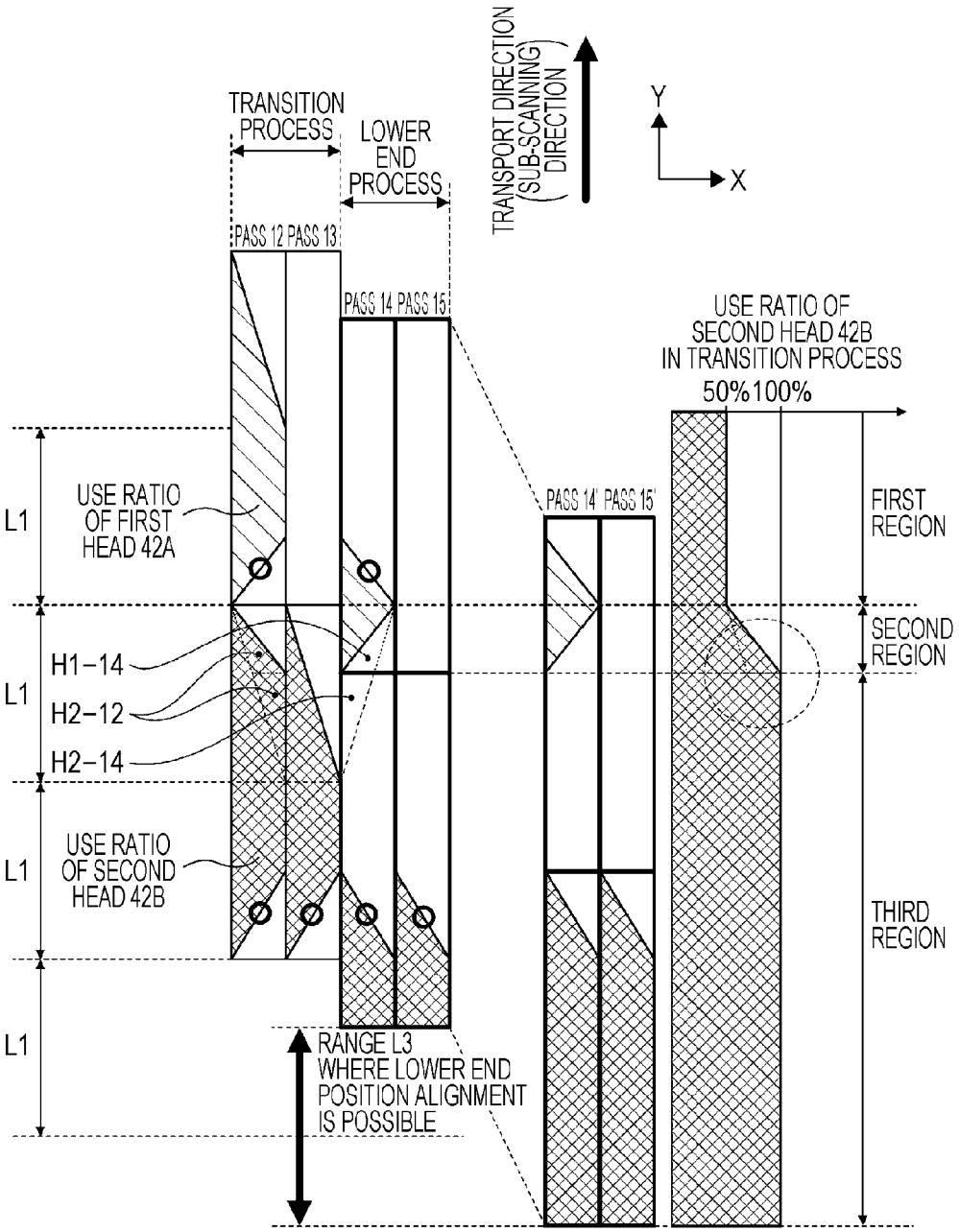
FIG. 12 is a graph illustrating the head use ratio of each of the first head and the second head in Example 2.

FIG. 12 is a graph illustrating the head use ratio of each of the first head 42A and the second head 42B which are provided in the ink jet printer 100 similarly to FIG. 11. FIG. 12 illustrates the passes after the pass 12 to describe the difference from Example 1.

In this example, the inclinations of parts marked with circles in the passes 12 to 15 illustrated in FIG. 12 are changed from those of Example 1. Specifically, the rate of change in the use ratio of the nozzles included in each of the heads in the −Y direction in each raster line in each of the passes is increased, and the use range of the nozzles (the number of nozzles being used, which are continuously lined up in the Y direction in each of the heads) in the lower end process (the passes 14 and 15) is decreased.

As a result, as in passes 14' and 15' illustrated in FIG. 12, the positions of the first head 42A and the second head 42B can be shifted in the −Y direction (that is, the corresponding nozzles are shifted in the Y direction). This has an effect that the width of a range L3 where position alignment with respect to the lower end position of the sheet 10 is possible can be increased. That is, this means that lower end process positions (positions of the first head 42A and the second head 42B in the Y direction, which are subjected to the passes 14 and 15) after the normal process (the pass 11 and the preceding the passes) and the transition process (the passes 12 and 13) are performed can more flexibly correspond to the sizes of various types of sheets 10 in the range of L3 of FIG. 12.

In addition, Example 2 does not affect the change in the second head use ratio in the second region compared to Example 1, and thus the same effect as that of Example 1 can be obtained in Example 2. Here, the inclined parts marked with circles are parts subjected to the POL control between the corresponding passes, and since the parts with smaller inclinations are more effective in the POL control, it is preferable that the rate of change (the inclination of the circle-marked parts in the Y-axis direction) in the use ratio of the nozzles in the −Y direction be not very high.

Other Embodiments

In the above-described embodiment, the ink jet printer is described. However, it is natural that disclosures of a printing apparatus, a recording apparatus, a liquid discharging apparatus, a printing method, a recording method, a liquid discharging method, a printing system, a recording system, a computer system, a program, a storage medium that stores a program, a display screen, a screen display method, a method of manufacturing a printing matter, and the like are also included.

In addition, although the ink jet printer is described as the embodiment, the above-described embodiment is for the purpose of easily understanding the invention and is not construed as limiting the invention. It is natural that the invention can be modified and improved without departing from the gist thereof and the invention includes the equivalent thereof. Particularly, embodiments described below are also included in the invention.

Printer

In the above-described embodiment, the ink jet printer is described, but the invention is not limited thereto. For example, the same technology as described in this embodiment may be applied to various types of liquid discharging apparatuses that apply the ink jet technology such as a color filter manufacturing apparatus, a dyeing apparatus, a fine processing apparatus, a semiconductor manufacturing apparatus, a surface processing apparatus, a three-dimensional molding machine, a liquid vaporizing apparatus, an organic EL manufacturing apparatus (particularly a polymer EL manufacturing apparatus), a display manufacturing apparatus, a film forming apparatus, and a DNA chip manufacturing apparatus. In addition, such methods or manufacturing methods also belong to the category of the range of the application. Even when this technology is applied to such fields, since the characteristics in which a liquid can be directly discharged (directly imaged) onto an object material are provided, printing, recording, image formation, and the like can be performed with higher quality than that according to the related art.

Inks

Since the above-described embodiment relates to the ink jet printer, discharged droplets are described as ink. However, the liquid discharged from the nozzle is not limited to the ink. For example, the liquid may be a liquid (including water) which includes a metallic material, an organic material (particularly a polymer material), a magnetic material, a conductive material, a wiring material, a film forming material, an electronic ink, a working liquid, a gene solution, or the like.

Type of Head

In the above-described embodiment, the example in which the piezoelectric element is used as the drive element for discharging ink droplets is described. However, the type of the head is not limited thereto, and may be other recording types in which dot groups are formed on a recording medium by ejecting ink as droplets. For example, a type in which ink is continuously ejected as droplets from a nozzle in a strong electric field between accelerating electrodes which are positioned in front of nozzles and a printing information signal is applied from a deflecting electrode for recording while the ink droplets are being projected, a type (electrostatic attraction type) in which the ink droplets are ejected according the printing information signal without being deflected, a type in which ink is pressurized by a small pump and nozzles are caused to mechanically vibrate by a crystal oscillator or the like to forcibly eject ink droplets, a type (thermal jet type) in which ink is heated to foam by a microelectrode according to a printing information signal so as to eject ink droplets for recording, and the like may be employed.

Number of Heads

In the above-described embodiment, the number of heads constituting the head set is two, but may also be three or more. If the number of heads is three or more, when the upper end process or the normal process is performed, the upper end region in which dots are formed only by a single head and the normal region in which dots are formed by the plurality of heads are present. In addition, even in the case where the number of heads is three or more, when the same processes as those of the above-described embodiment are performed, the difference in image quality between the upper end region and the normal region is less likely to be recognized.

Direction of Nozzle Arrangement in Appearance

In the invention, "the direction in which the nozzles are arranged" is not necessarily limited to the direction in which discharge holes which are physically formed are lined up.

For example, in a case where the pitch between the opening diameters of the discharging hole and the adjacent discharge hole (discharge holes sequentially positioned in a row) is short in the arrangement or the like, there may be a case where the nozzles are obliquely arranged. In the case where the nozzles are obliquely arranged, the nozzles may be configured to be lined up in the Y-axis direction in appearance by delaying a timing at which ink is discharged with respect to the scanning speed in the X-axis direction by the carriage unit 30. For example, in the scanning operation in the +X direction, the discharge timing of the discharge hole disposed at a position shifted by a length of −d is delayed by $t_d$ (=d/scanning speed) to correct the shift.

Even in this case, that is, even in the case where the nozzles are not physically arranged in the Y-axis direction but are virtually arranged in the Y-axis direction, the direction of the virtual arrangement may also be considered as "the direction in which the nozzles are arranged" of the invention.

The entire disclosure of Japanese Patent Application No. 2013-174218, filed Aug. 26, 2013 is expressly incorporated by reference herein.

What is claimed is:

1. A droplet discharging method comprising:

alternately repeating a droplet discharging operation of discharging droplets onto a medium by using a first head and a second head that move in an X direction or in a −X direction and a medium moving operation of moving the medium in a Y direction intersecting the X direction to form a plurality of dots on a first region of the medium, a second region which is positioned in a −Y direction from the first region to be connected to the first region, and a third region which is positioned in the −Y direction from the second region to be connected to the second region, wherein the dots are formed on the first region by using the first head and the second head so that, when a ratio of the number of dots formed by using the second head to the sum of the number of dots formed by using the first head and the number of dots formed by using the second head is referred to as a second head use ratio in rows of the dots which are lined up in the X direction, the second head use ratio is constant, the dots are formed on the second region by using the first head and the second head to cause the second head use ratio to be increased from a value less than a first set value to a value greater than a second set value greater than the first set value in the −Y direction in a plurality of rows of the dots lined up in the X direction, and the dots are formed on the third region by using the second head.

2. The droplet discharging method according to claim 1, wherein the first head and the second head are provided with a plurality of nozzles which discharge the droplets and are lined up in the Y direction, and when the droplet discharging operation which is performed by moving the first head and the second head once in the X direction or in the −X direction is referred to as one pass and a ratio of the number of dots formed in one pass by using the second head to the sum of the number of dots formed by using the first head and the number of dots formed by using the second head is referred to as a second head one pass use ratio in the rows of the dots which are lined up in the X direction, the second head one pass use ratio in the second region is increased from a value less than a third set value to a value greater than a fourth set value greater than the third set value and is decreased from the value greater than the fourth set value to a value less than the third set value in the −Y direction in the plurality of rows of the dots which are formed in one pass by the plurality of nozzles provided in the second head and are lined up in the X direction.

3. The droplet discharging method according to claim 1, wherein the first set value is 70%, and the second set value is 80%.

4. The droplet discharging method according to claim 1, wherein the first head is positioned in the Y direction with respect to the second head.

5. The droplet discharging method according to claim 1, wherein the first head and the second head which discharge the droplets having the same composition are mounted in a carriage as a head set, and the droplet discharging operation causes the carriage to move in the X direction or the −X direction.

6. The droplet discharging method according to claim 5, wherein a plurality of the head sets are mounted in the carriage, and the droplets from the respective head sets have different compositions.

7. A droplet discharging method comprising:

alternately repeating a droplet discharging operation of discharging droplets onto a medium by using a first head and a second head that move in an X direction or in a −X direction and a medium moving operation of moving the medium in a Y direction intersecting the X direction to form a plurality of dots on the medium, wherein, in a case where all the dots are formed at all the positions on the medium, where the dots can be formed, by using the first head and the second head, a first region which is formed of a plurality of the dots formed by using the first head and the second head so that, when a ratio of the number of dots formed by using the second head to the sum of the number of dots formed by using the first head and the number of dots formed by using the second head is referred to as a second head use ratio in rows of the dots which are lined up in the X direction, the second head use ratio is constant, a second region which is positioned in a −Y direction from the first region to be connected to the first region and is formed of a plurality of the dots formed by using the first head and the second head to cause the second head use ratio to be increased from a value less than 70% to a value greater than 80% in the −Y direction, and a third region which is formed of a plurality of the dots formed by using the second head are formed.

8. A droplet discharging apparatus comprising:

a first head and a second head which form dots by discharging droplets onto a medium;

a scanning moving unit which moves the first head and the second head in ±X directions on the medium;

a medium moving unit which moves the medium in a Y direction intersecting the X direction; and a control unit which performs control of driving of the scanning moving unit and the medium moving unit and control discharging of the droplets from the first head and the second head, wherein the control unit alternately repeats a droplet discharging operation of discharging the droplets onto the medium by using the first head and the second head that are moved by the scanning moving unit in the X direction or in the −X direction and a medium moving operation of moving the medium by the medium moving unit in the Y direction intersecting the X direction to form the dots on a first region by using the first head and the second head so that, when a ratio of the number of dots formed by using the second head to the sum of the number of dots formed by using the first head and the number of dots formed by using the second head is referred to as a second head use ratio in rows of the dots which are lined up in the X direction, the second head use ratio is constant, to form the dots on a second region which is positioned in a −Y direction from the first region to be connected to the first region by using the first head and the second head so that the second head use ratio is increased from a value less than a first set value to a value greater than a second set value greater than the first set value in the −Y direction in a plurality of rows of the dots lined up in the X direction, and to form the dots on a third region which is positioned in the −Y direction from the second region to be connected to the second region by using the second head.

9. The droplet discharging apparatus according to claim 8, wherein the first head and the second head are provided with a plurality of nozzles which discharge the droplets and are lined up in the Y direction, and when the droplet discharging operation which is performed by moving the first head and the second head once in the X direction or in the −X direction is referred to as one pass and a ratio of the number of dots formed in one pass by using the second head to the sum of the number of dots formed by using the first head and the number of dots formed by using the second head is referred to as a second head one pass use ratio in the rows of the dots which are lined up in the X direction, the control unit causes the second head one pass use ratio in the second region to be increased from a value less than a third set value to a value greater than a fourth set value greater than the third set value and to be decreased from the value greater than the fourth set value to a value less than the third set value in the −Y direction in the plurality of rows of the dots which are formed in one pass by the plurality of nozzles provided in the second head and are lined up in the X direction.

10. The droplet discharging apparatus according to claim 8, wherein the first set value is 70%, and the second set value is 80%.

11. The droplet discharging apparatus according to claim 8, wherein the first head is positioned in the Y direction with respect to the second head.

12. The droplet discharging apparatus according to claim 8, wherein the first head and the second head which discharge the droplets having the same composition are mounted in a single carriage as a head set.

13. The droplet discharging apparatus according to claim 12, wherein a plurality of the head sets are mounted in the carriage, and the droplets from the respective head sets have different compositions.

* * * * *